US007956840B2

(12) United States Patent
Ishii

(10) Patent No.: US 7,956,840 B2
(45) Date of Patent: Jun. 7, 2011

(54) ELECTRO-OPTICAL DEVICE, DRIVING METHOD, AND ELECTRONIC APPARATUS

(75) Inventor: Tatsuya Ishii, Fujimi-cho (JP)

(73) Assignee: Seiko Epson Corporation, Tokyo (JP)

( * ) Notice: Subject to any disclaimer, the term of this patent is extended or adjusted under 35 U.S.C. 154(b) by 1113 days.

(21) Appl. No.: 11/422,506

(22) Filed: Jun. 6, 2006

(65) Prior Publication Data

US 2006/0284683 A1 Dec. 21, 2006

(30) Foreign Application Priority Data

Jun. 17, 2005 (JP) ..... 2005-177307
Mar. 31, 2006 (JP) ..... 2006-098049

(51) Int. Cl.
*G09G 3/36* (2006.01)

(52) U.S. Cl. ..... 345/103; 345/99; 345/100; 348/790; 348/791; 348/792

(58) Field of Classification Search ..... 345/103, 345/99, 100; 348/790–792
See application file for complete search history.

(56) References Cited

U.S. PATENT DOCUMENTS 6,731,266 B1 * 5/2004 Jung ..... 345/103
6,806,862 B1 * 10/2004 Zhang et al. ..... 345/103

FOREIGN PATENT DOCUMENTS

JP A-2000-112437 4/2000

* cited by examiner

*Primary Examiner* — Richard Hjerpe
*Assistant Examiner* — Saifeldin Elnafia
(74) *Attorney, Agent, or Firm* — Oliff & Berridge PLC

(57) ABSTRACT

An electro-optical device includes: a plurality of data lines blocked for every "m" (m is an integer of 2 or greater) columns; a sampling signal output circuit which outputs sampling signals; and a sampling circuit which has sampling switches provided in the data lines, respectively, and which turns on the sampling switches to sample data signals supplied to "n" (n is an integer of 2 or greater) image signal lines, to the data lines. The sampling circuit groups the blocks for every "n" blocks, makes individual blocks in the same group correspond to different image signal lines, respectively, to connect the sampling switches in the individual blocks to corresponding image signal lines, supplies one sampling signal to two adjacent groups, and when any one sampling signal is supplied, simultaneously turns on sampling switches in the same columns in "n" blocks belonging to one group of two groups.

10 Claims, 37 Drawing Sheets

ELECTRO-OPTICAL DEVICE, DRIVING METHOD, AND ELECTRONIC APPARATUS

BACKGROUND

1. Technical Field

The invention relates to a technique of suppressing deterioration of display quality when so-called phase-developed data signals are sampled.

2. Related Art

In recent years, projectors in which a small reduced image is formed using a display panel of liquid crystal or the like, and this small reduced image is enlarged and projected by an optical system have come into wide spread. The projectors themselves have no function to create images, and receive image data (or image signals) from host apparatuses, such as a personal computer and a television tuner. Since this image data which specifies the grayscale (brightness) of pixels is supplied in a format in which the pixels arrayed in a matrix is scanned vertically and horizontally, display panels used for the projectors also are appropriately driven according to this format. Therefore, the display panels used for the projectors generally are driven by a dot sequential method in which scanning lines are selected in a predetermined order one row by one row, data lines are selected sequentially one column by one column in a period in which one row of the scanning lines are selected, and data signals, which are obtained by converting image data so as to be suitable for driving of liquid crystal, are supplied to the selected data lines.

On the other hand, making display images high in definition have recently progressed like Hi-Visions. Although high definition display images can be achieved by increasing the number of rows of scanning lines, and the number of columns of data lines, frame frequency is fixed. Thus, one horizontal scanning period is shortened due to an increase in the number of rows of scanning lines, and a select period of data lines is also shortened in the dot sequential method due to an increase in the number of columns of data lines. Therefore, with the progression of high definition, the dot sequential method cannot sufficiently ensure the time taken to supply data signals to the data lines, which results in inadequate write-in to pixels.

Thus, a method called phase development driving has been invented for the purpose of canceling the inadequate write-in (refer to JP-A No. 2000-112437). This phase development driving is a method in which data lines are grouped for every predetermined columns, for example, every four columns (every six columns in JP-A No. 2000-112437), and are selected in a predetermined order by four columns in one horizontal scanning period, and data signals extended four times the length of the time axis are supplied to the selected four columns of data lines, respectively. Since this phase development driving method can ensure the time taken to supply data signals up to 4 times in this example as compared with the dot sequential method, it is considered suitable for high definition of display images.

Meanwhile, in such a phase development driving method, unevenness in the shape of a vertical stripe that the grayscales of pixels differ delicately every four columns of simultaneous selection is caused, and thereby deterioration of display quality becomes conspicuous.

SUMMARY

An advantage of the invention is that it provides an electro-optical device, a driving method, and an electronic apparatus, which can suppress deterioration of display quality when a phase development driving method is adopted.

According to an aspect of the invention, an electro-optical device includes: a plurality of scanning lines, a plurality of data lines blocked for every "m" (m is an integer of 2 or greater) columns, pixels provided corresponding to the scanning lines and the data lines and showing grayscale specified by data signals sampled to data lines when a scanning line is selected, image signal lines, a scanning line driving circuit which selects the scanning line in a predetermined order, a sampling signal output circuit which sequentially outputs a plurality of sampling signals, and a sampling circuit which has a sampling switches for each data lines, and the sampling switches being connected to the corresponding data lines, the sampling circuit turning on the sampling switches to sample data signals supplied to "n" (n is an integer of 2 or greater) of the image signal lines, to the data lines, the blocks being grouped into "n" blocks, individual blocks in the same group corresponding to different image signal lines, and the sampling switches in the individual blocks being connected to corresponding image signal lines, one sampling signal being supplied to two adjacent groups, and when any one sampling signal is supplied, sampling switches in the same columns in "n" blocks belonging to one group of two groups corresponding to the sampling signal are simultaneously turned on. According to the aspect of the invention, it is possible to avoid a state in which the number of times of generation of sampling in adjacent data lines after sampling to data may become fixed.

In the aspect of the invention, preferably, the sampling circuit turns on sampling switches in any numbered columns in "n" blocks belonging to one group of two groups corresponding to the sampling signal, and thereafter, turns on sampling switches in any numbered columns in "n" blocks belonging to the other group.

Moreover, the sampling circuit may turn on sampling switches in the same columns in two groups corresponding to the sampling signal, in a predetermined order for every frame by groups over a period in which the sampling signal is supplied and a period in which a sampling signal next to the previous sampling signal is supplied.

In this configuration, the sampling circuit may turn on the sampling switches according to 2m or more predetermined control signals.

Furthermore, it is desirable that the distributions of the generation frequency of sampling in adjacent data lines after sampling of a data signal during one frame are made equal over individual data lines when at least "m" frames are defined as one cycle.

In addition, the sampling circuit may have an OR circuit which acquires an OR signal of two sampling signals, and an AND circuit which acquires an AND signal of the OR signal and any one of the 2m or more control signals, and may instruct either ON or OFF of sampling switches in any numbered columns in one group.

On ther other hand, in the aspect of the invention, the electro-optical device may include a processing circuit which supplies data signals of pixels corresponding to intersections of a selected scanning line and data lines whose sampling switches are turned on, to the "n" image signal lines.

In addition, the invention also includes concepts as a method of driving the electro-optical device, and an electronic apparatus having the electro-optical device, in addition to the electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

In the above-described phase development driving method, the inventor has considered that unevenness in the shape of vertical stripes in the period in which several columns are selected simultaneously is caused by factors that the conditions at the time of write-in of data signals via data lines are different between the data lines of simultaneous selection, and the conditions are fixed in terms of time.

Thus, respective embodiments as will be described below are intended to make it hard to visually recognize unevenness in the shape of vertical stripes by changing the conditions at the time of write-in of data signals via data lines over a plurality of frames (vertical scanning period), and making write-in conditions of the data lines equal to each other when a plurality of frames are defined as one cycle

First Embodiment

Figure 1:
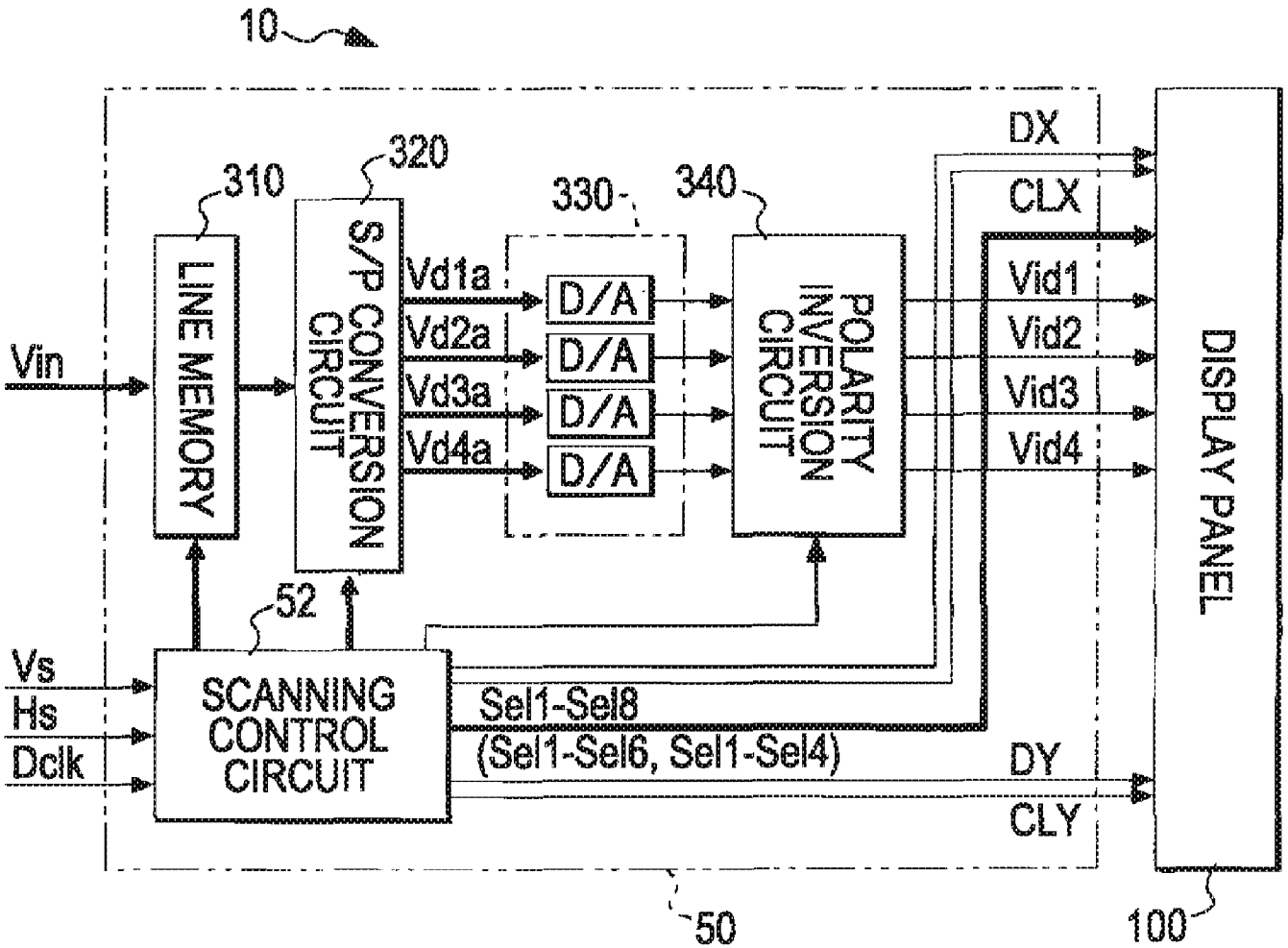
FIG. 1 is a view showing an entire configuration of an electro-optical device according to a first embodiment of the invention.

First, an electro-optical device (m=4, n=4) according to a first embodiment of the invention will be described. FIG. 1 is a block diagram showing an entire configuration of this electro-optical device.

As shown in this drawing, the electro-optical device 10 is classified roughly into a processing circuit 50 and a display panel 100. Of them, the processing circuit 50 is a circuit which controls operation; etc. of the display panel 100, and a circuit module mounted on a printed circuit board, and is connected with the display panel 100 by an FPC (Flexible Printed Circuit) board, etc.

The processing circuit 50 is further classified into a scanning control circuit 52, a line memory 310, an S/P conversion circuit 320, a D/A conversion circuit group 330, and a polarity inversion circuit 340.

The line memory 310 stores one row or image data Vin supplied from a host apparatus (not shown) in synchronization with vertical scanning signals Vs, horizontal scanning signals Hs, and dot clock signals Dclk, and then changes the order of the image data and reads out it according to instructions by the scanning control circuit 52. Here, the image data Vin is digital data which specify the grayscale (brightness) of pixels.

The S/P conversion circuit 320 extends the image data read out from the line memory 310 to 4 times of the length of time axis (also referred to as serial/parallel conversion and phase development), and distributes the extended image data in four series to output it as image data Vd1*a* to Vd4*a*. In addition, since the image data Vin is not supplied in a blanking period, the S/P conversion circuit 320 replaces the read-out image data with the data which makes pixels black (lowest luminance display) in the blanking period, to output the replaced data as image data Vd1*a* to Vd4*a*.

The D/A conversion circuit group 330 is an assembly of D/A converters provided for every series, and converts the image data Vd1*a* to Vd4*a* into analog voltages according to grayscale values.

In addition, although this embodiment is configured such that the image data Vin is analog-converted after its serial/parallel conversion, it is natural that the image data is analog-converted before its serial/parallel conversion.

The polarity inversion circuit 340 converts the four series of D/A-converted analog signals into signals having a potential voltage higher than a voltage Vc by the voltages of the analog signals when the analog signals are instructed to assume positive polarity by the scanning control circuit 52. On the other hand, the polarity inversion circuit converts the analog signals into signals having a potential lower than the voltage Vc to output them as data signals Vid1 to Vid4, respectively, when the analog signals are instructed to assume negative polarity by the scanning control circuit. In addition, these data signals Vid1 to Vid4 are supplied to four image signal lines 171 in the display panel 100.

Here, although the voltage Vc is not particularly illustrated, it is an amplitude reference potential of a data signal, and a reference of the polarity of the voltage of a data signal, and almost the intermediate voltage of a power supply voltage (Vdd-Gnd). In other words, in this embodiment, with respect to a data signal, the higher potential side than the voltage Vc is called positive polarity and the lower potential side than the voltage Vc is called negative polarity. In addition, the measurement reference value of a voltage is based on the ground potential Gnd of a power source, particularly as long as there is no description about it.

The reason for reversing the polarity of a data signal by the polarity inversion circuit 340 is for alternating current driving of pixels. Here, although there are here various aspects, such as (a) polarity reversals for every scanning line, (b) porality reversoals for every data line, (c) porality reversals for every pixel, and (d) porality reversals for every surface (frame), about hot to reverse pixels in one frame, suppose that (a) the polarity reversals for every scanning line is performed in this embodiment. However, this is not meant to limit the invention.

The scanning control circuit 52 mainly has a first function which controls the scanning of the display panel 100, a second function which controls phase development of the above-mentioned S/P conversion circuit 320 to synchronize with the horizontal scanning of the display panel 1000, and the third function which controls to read out one row of image data Vin stored in the line memory 310 in the order determined according to this phase development and a frame number.

Here, when the first function is explained in full detail, the scanning control circuit 52 generates transfer starting pulses DX and clock signals CLX from the dot clock signals Dclk, the vertical scanning signals Vs, and the horizontal scanning signals Hs supplied from a host apparatus to control the horizontal scanning of the display panel 100, and generates transfer starting pulses DY and clock signals CLY to control vertical scanning of the display panel 100. Besides, the scanning control circuit outputs control signals Sel1 to Sel8, which are set to an H level, exclusively sequentially in the order determined according to a frame number.

Here, the frame number is a number for distinguishing a vertical scanning period (frame). In this embodiment, there are four numbers from "1" to "4".

On the other hand, the display panel 100 has a configuration in which an element substrate and a counter substrate on which a common electrode is formed are bonded together by sealant with a constant gap, and liquid crystal is sealed in this gap. A predetermined image is formed by electro-optical changes of the liquid crystal.

Figure 2:
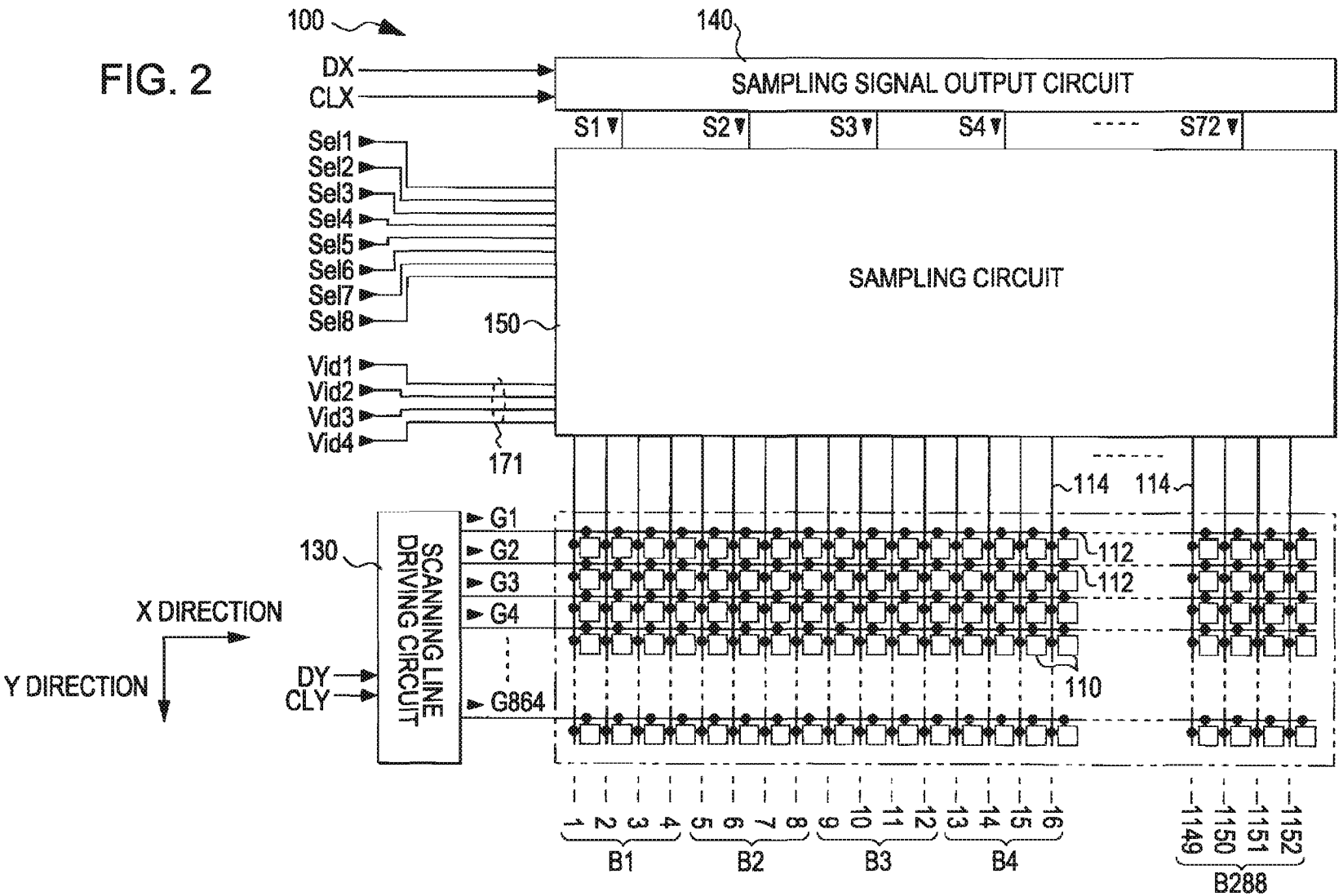
FIG. 2 is a view showing a configuration of a display panel in the electro-optical device.

For the details of the display panel 100, as shown in in FIG. 2, scanning lines 112 of 864 rows extend in the X (horizontal) direction in the drawing, while data lines 114 of 1152 columns extend in the Y (vertical) direction in the drawing. The pixels 110 are provided so as to correspond to intersecting parts, respectively, of the scanning lines 112 and the data lines 114. Accordingly, in this embodiment, the pixels 110 are arrayed in a matrix of 864 rows×1152 columns in display regions shown by rectangular frames of two-dot chain lines. However, in this embodiment, since the pixels in 1st to 16th columns and the 1137th to 1152nd columns are used as dummy pixels for the reason described below, these dummy pixels are shieded by a black matrix, etc. Accordingly, in this embodiments the array of pixels, which are effective for display, becomes 864 rows×1120 columns except 16 columns on each of the right and left.

In addition, in this embodiment, the data lines 114 of 1152 columns are blocked every four columns. Thus, for the sake of convenience of explanation, 1st, 2nd, 3rd, and 288th blocks when being numbered from the left are denoted by B1, B2, B3, . . . , and B288, respectively.

Figure 3:
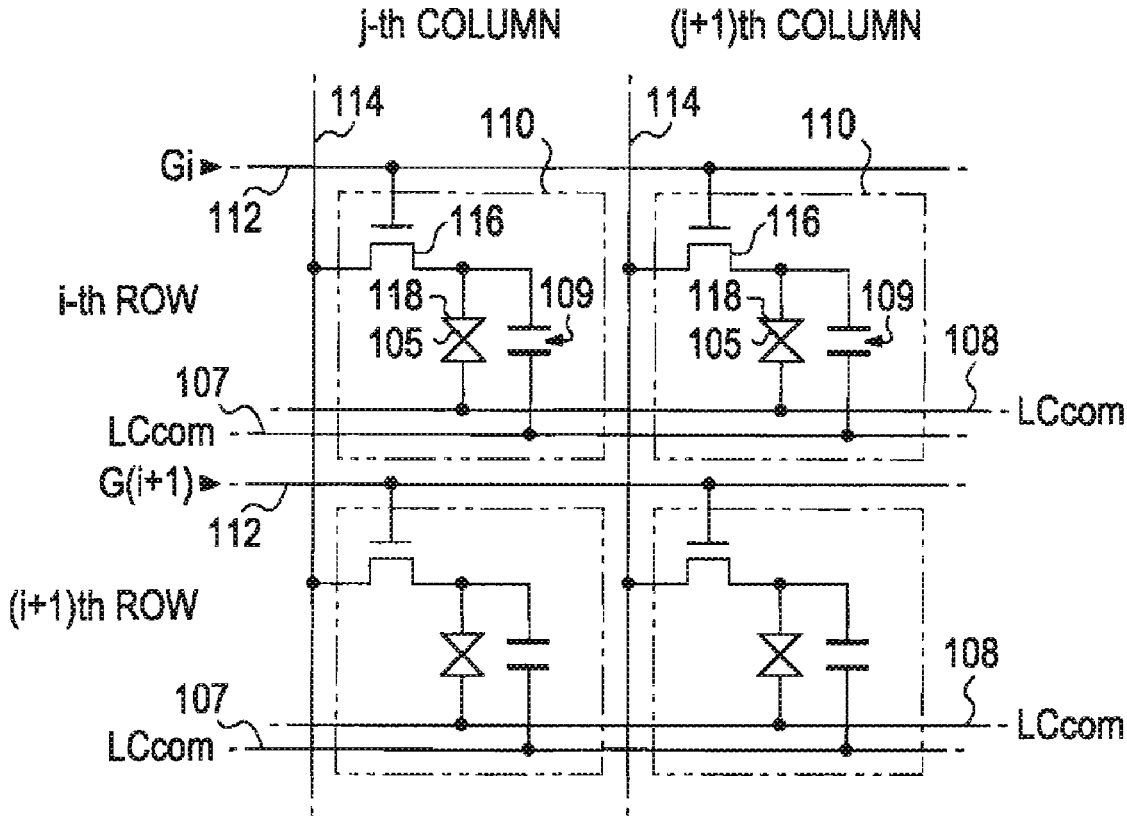
FIG. 3 is a view showing a configuration of pixels in the display panel.

FIG. 3 is a view showing the detailed configuration of pixels 110 in the display panel 100, and shows a configuration of a total of 4 pixels of 2×2 corresponding to the intersections of an ith row and an (i+1)th row adacennt thereto, and a j-th column and (j+1)th column adjacent thereto. Here, i and (i+1) are symbols when the rows in which the pixels 110 are arrayed are generally represented, and they are integers of not less than 1 and not more than 864, and j and (j+1) are symbols when the columns which the pixels 110 are arrayed are generally represented, and they are integers of not less than 1 and not more than 1152.

As shown in FIG. 3, in each pixel 3, the source of an n-channel-type TFT (thin film transistor) 116 is connected to each data line 114, the drain thereof is connected to each pixel electrode 118, and the gate thereof is connected to each scanning line 112.

Moreover, the common electrode 108 is formed in common to all the pixels so as to face the pixel electrodes 118 formed in the element substrate. Also, the liquid crystal 105 is sandwiched between thee pixel electrodes 118 and the common electrode 108. Therefore, a pixel capacitor composed of the pixel electrode 118, the common electrode 108, and the liquid crystal 105 is constructed for every pixel.

In addition, although a voltage Lccom, which is contant in time, is applied to the common electrode 108, in this embodiment, this voltage (potential) is the same as a reference voltage Vc. However, the constant voltage may be set to be on the potential side slightly lower than the reference voltage Vc for the reasons described below.

Although not shown particularly, each of the facing surfaces of both the substrates is provided with an aligned film which is subjected to rubbing treatment so that the direction of the major axes of liquid crystal molecules is continuously twisted by, for example, about 90 degrees between both substrates, and each of the back surfaces of both the substrates are provided with a polarizer according to an alignment direction.

If the effective value of a voltage which is applied to a pixel capacitor is zero, the light which passes through between the pixel electrodes 118 and the common electrodes 1038 optically rotates by about 90 degrees. On the other hand, as the voltage effective value becomes large, the liquid crystal molecules are inclined in an electric field direction, and as a result of that, the optical activity will disappear. Therefore, when polarizers are disposed on the incidence side and the back side, respectively, so that their polarization axes may coincide with the alignment direction, for example, in a transmission type, if the voltage effective value is close to zero, a white display is performed that the transmittance of light becomes the greatest. On the other hand, as the voltage effective value becomes large, the quantity of light transmitted decreaes, which results in a black display that the transmittance is the smallest (noramally white mode).

Moreover, in order to reduce the influence of leak of charges from the pixel capacitor through the TFT 116 at the time of OFF, a storage capacitor 109 is formed in every pixel. One end of this storage capacitor 109 is connected to the pixel electrode 113 (drain of the TFT 116), while the other end thereof is connected in common to a capacitance line 107 over all the pixels. Illustration of this capacitance line 107 is omitted in FIG. 2. However, as shown in FIG. 3, in th embodiment, the capacitance line is maintained at the same voltage LCcom as the common electrode 103. In detail, the capacitance line 107 is formed on the element substrate and the common electrode 108 is formed on the counter substrate. In this case, electricl connection between the capacitance line 107 and the common electrode 108 is established by a conductive material, which is not shown. Therefore, the pixel electrode 118 (drain of the TFT 116) and the common electrode 108 are configured such that the pixel capacitor and the storage capacitor are added in parallel to every pixel 110.

In addition, the TFT 116 in the pixel 110 is formed through a common manufacturing process with the scanning line driving circuit 130, the sampling signal output circuit 140, the sampling circuit 150, etc. which will be described below. This contributes to miniaturization and cost-down of the whole device.

In FIG. 2, peripheral circuits, such as the scanning line driving circuit 130, the sampling signal output circuit 140, the sampling circuit 150, are provided around a display region 100*a* in which the pixels 110 are arrayed.

Among the peripheral circuits, the scanning line driving circuit 130 supplies scanning signals G1, G2, G31, . . . , and G864 to the scanning lines 112, respectively, in the 1st, 2nd, 3rd, . . . and 864th rows. Although the details of the scanning line driving circuit 130 are omitted because it is not directly related to the invention, for example, the scanning line driving circuit, as shown in FIG. 5, is configured such that a transfer starting pulse DY which is supplied at the beginning of each vertical effective display period and has the pulse width (H level) equilvalent to the half period of a clock signal CLY is input with the timing that the level of the clock signal CLY shifts, so as to be a scanning signal G1, and this scanning signal G1 is delayed sequentially by every half period of the clock signal CLY, and output as scanning signals G2, G3, . . . , and G864.

In this embodiment, the verical scanning period is divided into a vertical blanking period and a vertical effective display period following this blanking period. Here, as shown in FIG. 5, the vertical effective display period is a period from the timing that the scanning signal G1 is set to an H level to the timing that the scanning signal G864 returns to an L level, and the vertical blanking period is a period of the vertical scanning period excluding the vertical effective display period.

Figure 5:
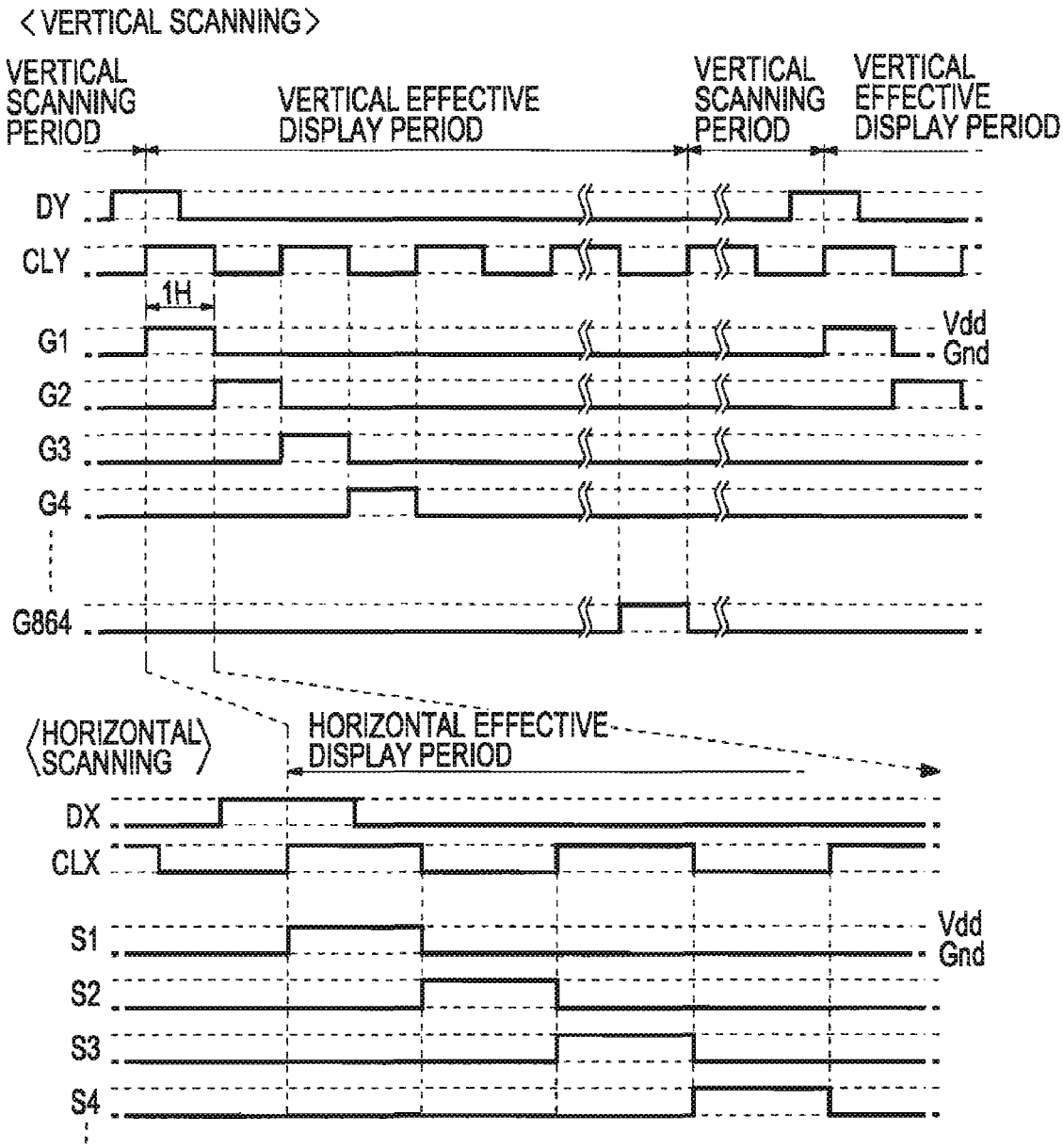
FIG. 5 is a view illustrating the operation of the electro-optical device.
Figure 6:
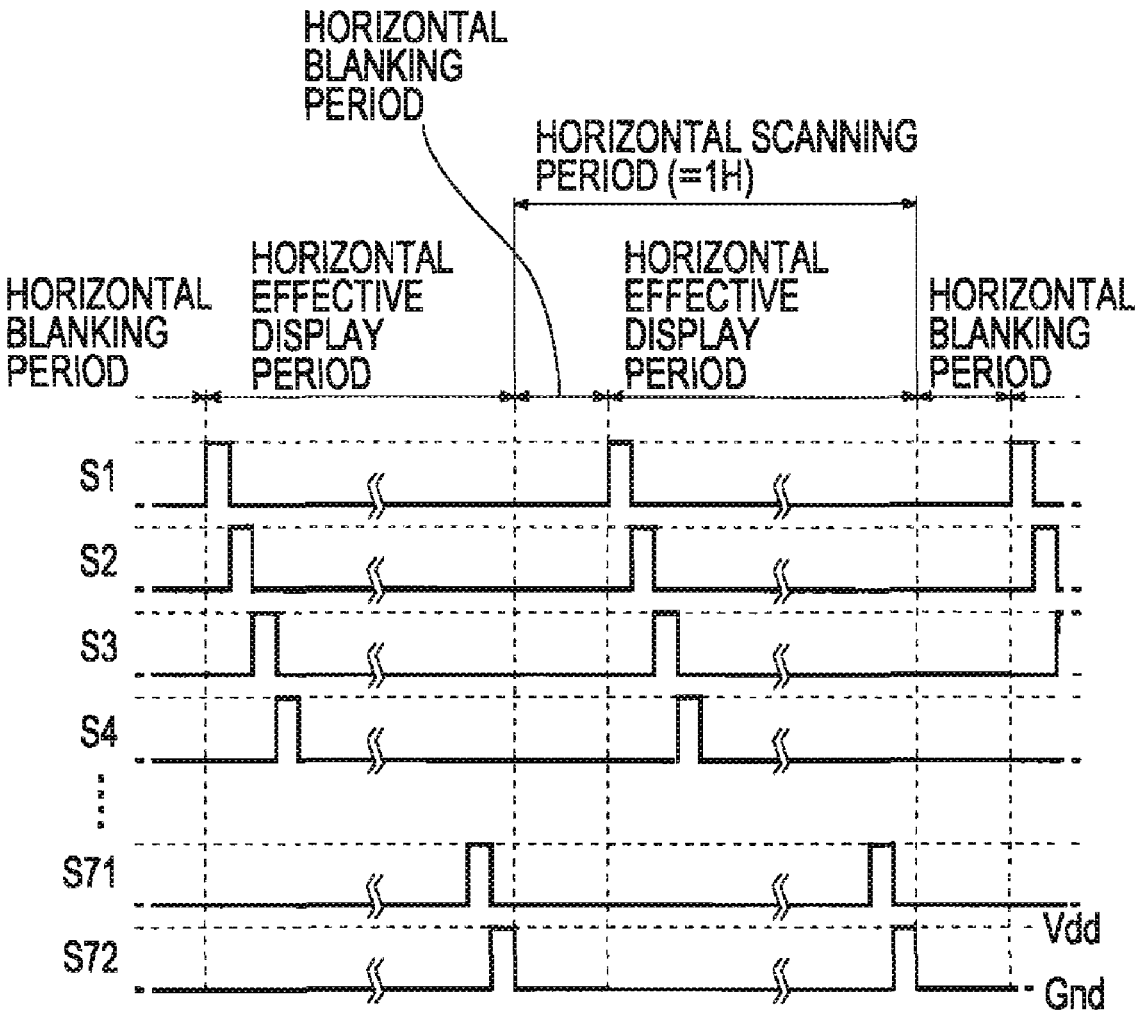
FIG. 6 is a view illustrating the operation of the electro-optical device.

Next, the scanning line driving circuit 140, as shown in FIG. 5 or 6, is configured such that a transfer starting pulse DX which is supplied at the beginning of each horizontal effective display period and has the pulse width (H level) equivalent to the half period of a clock signal CLX is input with the timing that the level of the clock signal CLX shifts, so as to be a sampling signal S1, and this sampling signal S1 is delayed sequentially by every half period of the clock signal CLX, and output as sampling signals S2, S3, . . . , and S72.

In this embodiment, the horizontal scanning period is divided into a horizontal blanking period and a horizontal effective display period following this blanking period. Here, as shown in FIG. 6, the horizontal effective display period is a period from the timing that the sampling signal S1 is set to an H level to the timing that the samping signal S72 returns to an L level, and the horizontal blanking period is a period of the horizontal scanning period excluding the horizontal effective display period.

On the other hand, the sampling circuit 150 samples the data signals Vid1 to Vid4 supplied through four image signal lines 171, respectively, to the data lines 114 which are defined according to the sampling signals S1 to S72 and the control signals Sel1 to Sel8.

Figure 4:
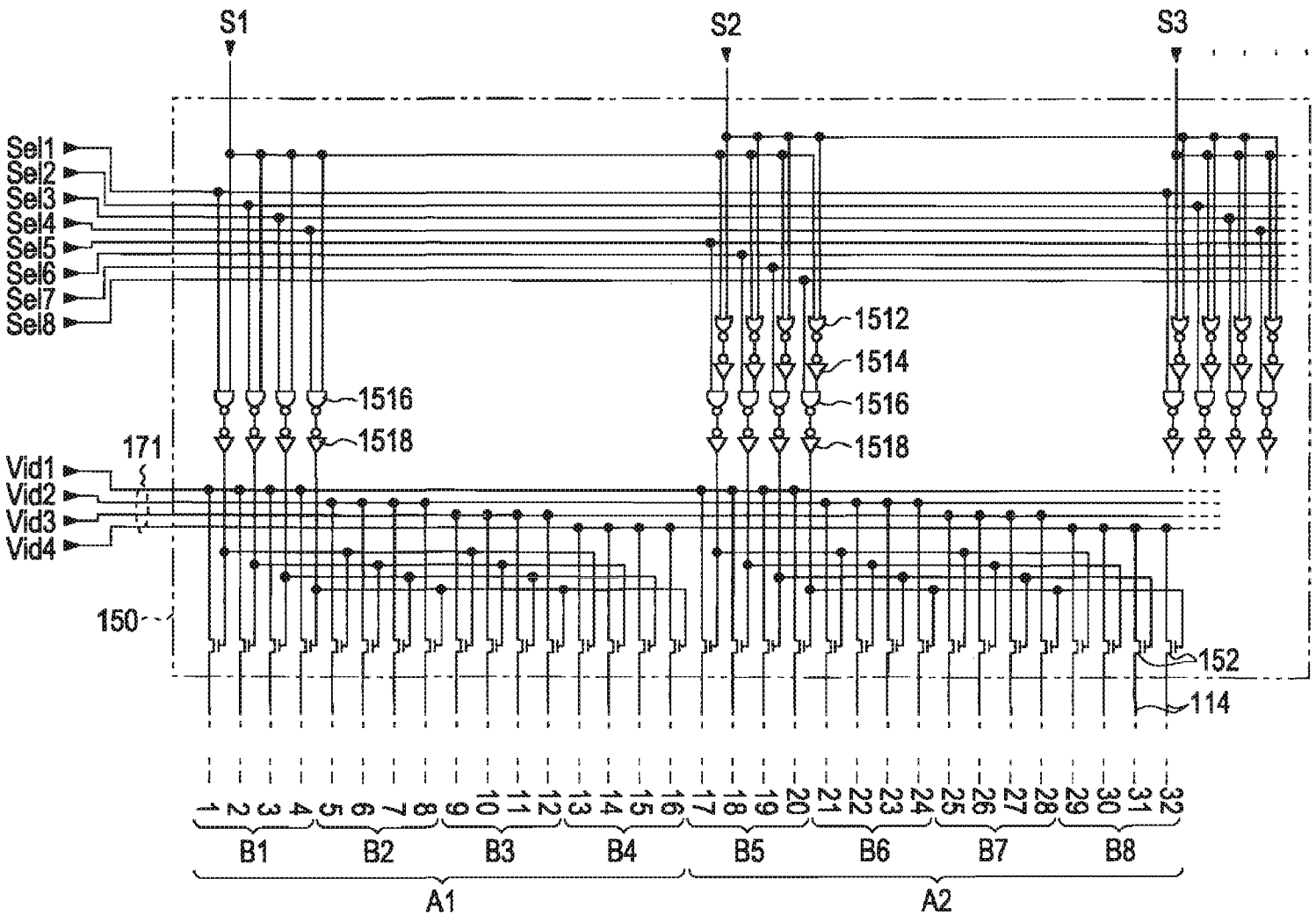
FIG. 4 is a view showing a configuration around a sampling circuit in the display panel.

The details of the sampling circuit 150 will be described with reference to FIG. 4.

Referring to this drawing, groups A1, A2, and . . . are obtained by grouping blocks B1 to B4 and B5 to B8, respectively. In addition, in this embodiment, since blocks to a block B288 exists, though not shown in FIG. 4, groups to a group A72 also exist.

Next, the groups A2 to A72 except the group A1 correspond to a sampling signal with the same number as each group number and a sampling signal with a number lower by one than the group number. For example, the sampling signal S2 and the sampling signal S1 lower by one than that corresponds to the group A2. In addition, with respect to the group A1, since a number lower than its group number "1" does not exist, only the sampling signal S1 corresponds to the group A1.

On the other hand, each data line 114 is provided with an n-channel-type TFT 152 as a transmission gate (sampling switch).

In detail, the drain of the TFT 152 is connected to a corresponding data line 114. Moreover, the sources of the TFTs 152 belonging to the blocks B1, B5, B9, . . . , and B285 are connected to a first image signal line 171 to which the data signal Vid1 is supplied. Similarly, the sources of the TFTs 152 belonging to the blocks B2, B6, B10 . . . , and B286 are connected to a second image signal line 171 to which the data signal Vid2 is supplied, the sources of the TFTs 152 belonging to the blocks B3, B7, B11, . . . , and B287 are connected to a third image signal line 171 to which the data signal Vid3 is supplied, and the sources of the TFTs 152 belonging to the blocks B4, B8, B12, . . . , and B288 are connected to a fourth image signal line 171 to which the data signal Vid4 is supplied.

In the individual blocks belonging to the same group, the gates of the TFTs 152 in the same columns are connected in common. For example, in the blocks B1 to B4 of the group A1, the gates of the TFTs 152 corresponding to individual 1st columns (1st, 5th, 9th and 13th columns when being viewed from the display region 100*a*) when being numbered from the left are connected in common. Similarly, the gates of the TFTs 152 corresponding to individual 2nd columns (2nd, 6th, 10th and 14th columns when being viewed from the display region 100*a*) when being numbered from the left are connected in common, the gates of TFTs 152 corresponding to individual 3rd columns (3rd, 7th, 11th and 15th columns when being viewed from the display region 100*a*) when being numbered from the left are connected in common, and the gates of TFTs 152 corresponding to individual 4th column-s (4th, 8th, 12th and 16th columns when being viewed from the whole display region 100*a*) when being numbered from the left are connected in common.

Here, the gate signals supplied to the TFTs 152 are divided into even-numbered groups and odd-numbered groups, and has the following relationship.

That is, each of the even-numbered groups (A2, A4, A6, . . . , and A72) is provided with four circuit sets corresponding to the control signals Sel5 to Sel8. Each of the four circuit sets is composed of a NOR circuit 1512 which outputs a NOR signal between two correponding sampling signals, a NOT circuit 1514 which outputs a NOT signal of the NOR signal, a NAND circuit 1516 which outputs a NAND signal of the NOT signal and any one of the control signals Sel5 to Sel8, and a NOT circuit 1518 which outputs a NOT signal of the NAND signal In addition, if the NOR circuit 1512 and the NOT circuit 1514 are combined together, they become a positive logical OR circuit, and if the NAND circuit 1516 and the NOT circuit 1518 are combined together, they become a positive Logical AND circuit.

The NOT signal of the NOT circuit 1518 output corresponding to the control signal Sel5 in four circuit sets corresponding to the control signals Sel5 to Sel8 becomes gate signals of the TFTs 152 corresponding to 1st columns in individual blocks belonging to an even-numbered group. Similarly, the NOT signals of the NOT circuits 1518 output corresponding to the control signals Sel6, Sel7 and Sel8 become gate signals of the TFTs 152 corresponding to 2nd, 3rd, and 4th columns in the individual blocks belonging to the even-numbered group.

On the other hand, although odd-numbered groups (A3, A5, A7, . . . , and A71) are common to the even-numbered groups in which they have a circuit set composed of a NOR circuit 1512, a NOT circuit 1514, a NAND circuit 1516, and a NOT circuit 1518, it is different from the even-numbered groups in that four circuit sets are provided corresponding to the control signals Sel1 to Sel4.

Among them, the NOT signal of the NOT circuit 1518 output corresponding to the control signal Sel1 becomes gate signals of the TFTs 152 corresponding to 1st columns in individual blocks belonging to an odd-numbered group. Similarly, the NOT signals of the NOT circuits 1518 output corresponding to the control signals Sel2, Sel3 and Sel4 become gate signals of the TFTs 152 corresponding to 2nd, 3rd, and 4th columns in the individual blocks belonging to the even-numbered group.

However, since only one sampling signal S1 corresponds to the first odd-numbered group A1 unlike other odd-numbered groups (A3, A5, A7, . . . , and A71), the NOR circuit 1512 and the NOT circuit 1514 do not exist in the first odd-numbered group.

Next, the operation of the electro-optical device 10 according to the first embodiment will be described.

In this embodiment, a transfer starting pulse DY is supplied to the scanning line driving circuit 130 at the beginning of one vertical scanning effective display period. Thereby supply, as shown in FIG. 5, the scanning signals G1, G2, G3, . . . , and G864 are set to an H level sequentially and exclusively in every one horizontal scanning period H. The operation of this scanning line driving circuit 130 is common over the first to fourth frame.

First, in the first frame, the horizontal effective display period in which the scanning signal G1 is set to an H level will be described. In addition, it is assumbed that write-in of positive polarity is performed in this horizontal effective display period.

Moreover, over the period in which the scanning signal G1 is set to an H level, the sampling signal output circuit 140 outputs sampling signals S1, S2, S3, . . . , and S72 in order so that they may be set to an H level sequentially and exclusively.

Figure 7:
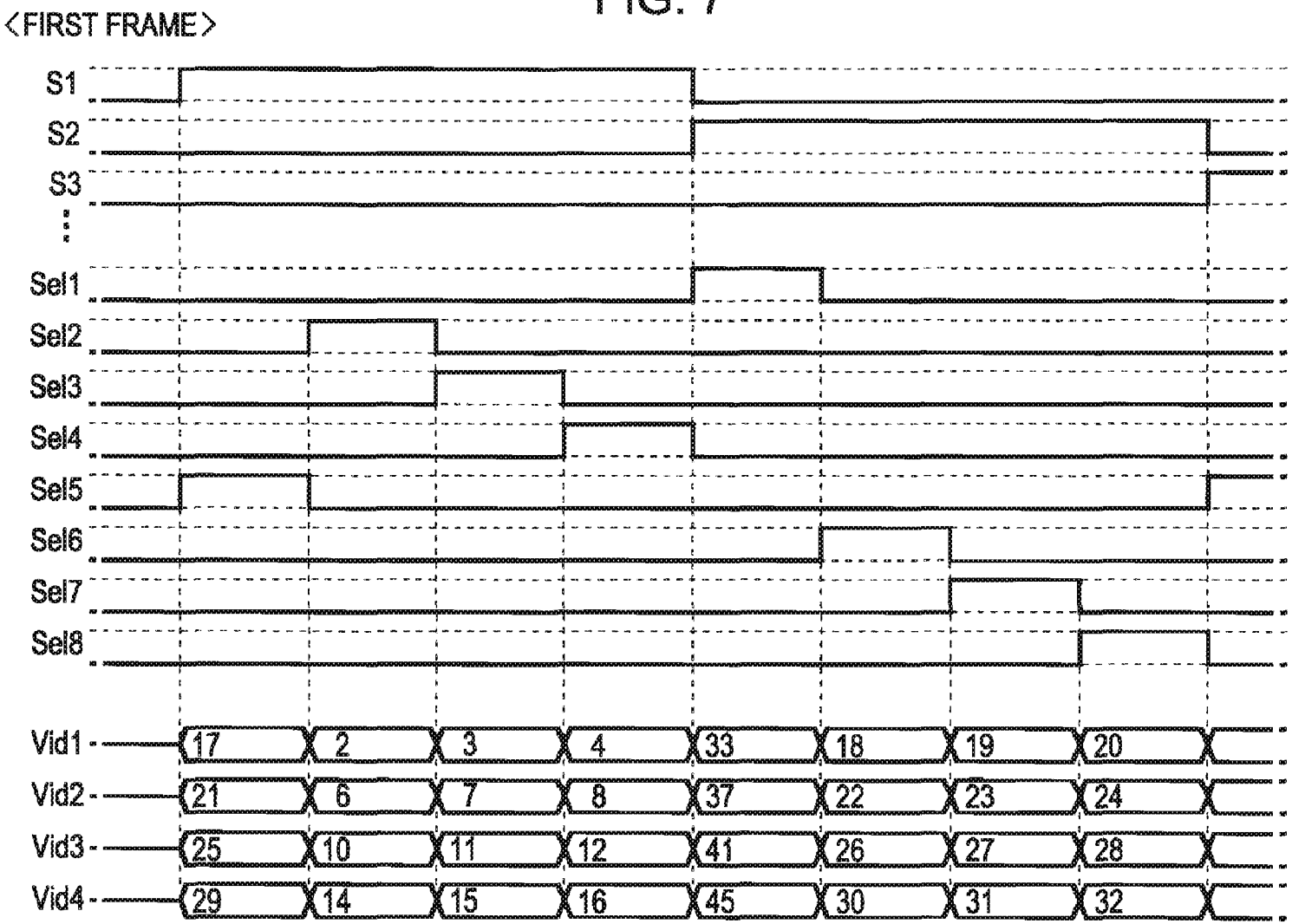
FIG. 7 is a view illustrating the operation of a first frame of the electro-optical device.

On the other hand, the scanning control circuit 52 outputs the control signals Sel1 to Sel8 as shown in FIG. 7 in the first frame. That is, the scanning control circuit 52 generates and output control signals Sel1 to Sel8 in synchronization with a sampling signal (clock signals CLX) so that the control signals may be exclusively set to an H level in order of Sel5→Sel2→Sel3→Sel4→Sel1→Sel6→Sel7→Sel8→(Sel5), and their period for which the control signals are set to the H level may become ¼ of a pulse width of the sampling signal which is set to an H level.

Here, if the number of a sampling signal which is set to an H level is an odd number, the control signals Sel1, Sel2, Sel3, and Sel4 designate sampling of a data signal to be supplied to an image signal line, with respect to the data lines in 1st columns, 2nd columns, 3rd columns, and 4th columns in individual blocks belonging to a group with the same number as the number of the sampling signal, and if the number of a sampling signal which is set to an H level is an even number, the control signals Sel1, Sel2, Sel3, and Sel4 designate sampling of a data signal to be supplied to an image signal line, with respect to the data lines in 1st columns, 2nd columns, 3rd columns, and 4th columns in individual blocks belonging to a group with a number greater by one than the number of the sampling signal.

On the other hand, if the number of a sampling signal which is set to an H level is an odd number, the control signals Sel5, Sel6, Sel7, and Sel8 designate sampling of a data signal to be supplied to an image signal line, with respect to the data lines in 1st columns, 2nd columns, 3rd columns, and 4th columns in individual blocks belonging to a group with a number greater by one the number of the sampling signal, and if the number of a sampling signal which is set to an H level is an even number, the control signals Sel5, Sel6, Sel7, and Sel8 designate sampling of a data signal to be supplied to an image signal line, with respect to the data lines in 1st columns, 2nd columns, 3rd columns, and 4th columns in individual blocks belonging to a group with the same number as the number of the sampling signal.

On the other hand, before the scanning signal G1 is set to an H level, as image data vin, the image data corresponding to the pixels 110 in the 1st, 2nd, 3rd, 4th, . . . , and the 1152nd columns of the 1st row are supplied in order, and stored in the line memory 310.

Here, in a state in which the scanning signal G1 is set to an H level and the sampling signal S1 is set to an H level in FIG. 7, when the control signal Sel5 is set to an H level, the scanning control circuit 52 reads out the image data Vin corresponding to the pixels in the 17th, 21st, 25th, and 29th columns of the 1st row, from the line memory 310. The read-out image data is extended to 4 times on an axis of time by the S/P conversion circuit 320, and distributed to four series of image data Vd1*a* to Vd4*a*, and converted into analog signals by the D/A data conversion circuit group 330. The converted analog signals are further turned into signals of positive polarity by the polarity inversion circuit 340 and output as data signals Vid1 to Vid4.

Thereby, the data signal Vid1 becomes a positive polarity voltage according to the grayscale of the pixel 110 in the 1st row and 17th column. Similarly, the data signals Vid2, Vid3, and Vid4 become a positive polarity voltage according to the grayscale of the pixels 110 in the 1st row and 21st column, the 1st row and 25th column, and the 1st row and 29th column, respectively.

Here, since the number of a sampling signal is "1" that is an odd number, when the control signal Sel5 is set to an H level, sampling of data signals are designated to the data lines 114 in 1st columns in the individual blocks B5 to B8 belonging to the group A2 (17th, 21st, 25th, and 29th columns when being viewed from the display region 100*a*) with a number greater by one than the number "1" of the sampling signal, as described above. Actually, when only the sampling signal S1 is at an H level and the control signal Sel5 is at an H level, only the gate signals of the TFTs 152 in 1st columns in the individual blocks B5 to B8 belonging to the group A2 is set to an H level.

As a result of the ON of th four TFTs 152, the data signal Vid1 of a positive polarity voltage according to the grayscale of the pixel 110 in the 1st row and 17th column is sampled to the data line 114 in the 17th column. Similarly, the data signals Vid2, Vid3, and Vid4 of a positive polarity voltage according to the grayscale of the pixels 110 in the 1st row and 21th column, the 1st row and 25th column, and the 1st row and and 29th column are sampled to the data lines 114 in the 21st, 25th, and 29th columns.

Since the scanning signal G1 is at an H level, all the TFTs 116 whose gates are connected to the scanning line 112 in the 1st row are turned on. Therefore, the data signal Vid1 sampled to the data line 114 in the 17th column is applied to a pixel electrode of a pixel in the 1st row and 17th column corresponding to an intersection of the scanning line 112 in the 1st row when being numbered from above in FIG. 2 and the data line 114 in the 17th row when being numbered from the left in FIG. 2. Similar to the above, the data signals Vid2, Vid3, and Vid4 sampled to the data lines 114 in the 21th, 25th, and 29th columns are also applied to the pixel electrodes 118, respectively, of the pixels in the 1st row and 21th column, the 1th row and 25th column, and the 1st row and 29th column.

Next, as shown in FIG. 7, when the control signal Sel2 is set to an H level, the scanning control circuit 52 reads out the image data Vin corresponding to the pixels in the 2nd, 6th, 10th, and 14th columns of the 1st row, from the line memory 310. Therefore, the data signal Vid1 becomes a positive polarity voltage according to the grayscale of the pixels 110 in the 1st row and 2nd column. Similarly, the data signals Vid2, Vid3, and Vid4 become a positive polarity voltage according to the grayscale of the pixels 110 in the 1st row and 6th column, the 1st row and 10th column, and the 1st row and 14th column, respectively.

If the number of a sampling signal is "1" that is an odd number, when the control signal Sel2 is set to an H level, sampling of data signals are designated to the data lines 114 in 1st columns in the individual blocks B1 to B4 belonging to the group A1 (2nd, 6th, 10th, and 14th columns when being viewed from the display region 100*a*) with the same number as the number "1" of the sampling signal. Actually, when only the sampling signal S1 is at an H level and the control signal Sel2 is at an H level, only the gate signals of the TFTs 152 in 1nd columns in the individual blocks B1 to B4 belonging to the group A1 is set to an H level. Thus, as a result of the ON of th four TFTs 152, the data signal Vid1 of a positive polarity voltage according to the grayscale of the pixel 110 in the 1st row and 2nd column is sampled to the data line 114 in the 2nd column. Similarly, the data signals Vid2, Vid3, and Vid4 of a positive polarity voltage according to the grayscale of the pixels 110 in the 1st row and 6th column, the 1st row and 10th column, and the 1st row and and 14th column are sampled to the data lines 114 in the 6th, 10th, and 14th columns.

Also, these sampled data signals Vid1 to Vid4 are applied to the pixel electrodes 118 of the pixels in the 1st row and 2nd column, the 1st row and 6th column, the 1st row and 10th column, and the 1th row and 14th column.

Similarly hereinafter, in the period in which the sampling signal S1 is set to an H level, the signals Sel3 and Sel4 are set to an H level. As a result, the sampling of the data signal supplied to the image signal line 171 is designated to four columns of data lines 114 in the 3rd columns or the 4th columns in the individual blocks B1 to B4 belonging to the group A1 with the same number as the number "1" of the sampling signal S1. Thereby, in the period in which the sampling signal S1 is set to an H level, when the signals Sel3 and Sel4 are set to an H level in order, the sampling of the data signal and write-in to the pixel electrodes 118 are performed in order on the data lines 114 in the 3rd columns and the 4th columns in the individual blocks B1 to B4 belonging to the group A1.

At the timing when the control signal Sel4 is set to an L level, and the next control signal Sel1 is set to an H level, the sampling signal S2 is set to an H level this time.

If the number of a sampling signal is "2" that is an even number, when the control signal Sel1 is set to an H level, sampling of data signals are designated to the data lines 114 in 1st columns in the individual blocks B9 to B12 belonging to the group A3 (33rd, 37th, 41st, and 45th columns when being viewed from the display region) with a number greater by one by than the number "2" of the sampling signal. Thereby, the sampling of a data signal and the write-in to the pixel electrode 118 are performed on the data lines 114 in the 1st columns of the individual blocks B9 to B12 belonging to the group A3.

Similarly hereinafter, in the period in which the sampling signal S2 is set to an H level, the signals Sel6, Sel7, and Sel8 are set to an H level. As a result, the sampling of the data signal supplied to the image signal line 171 is designated in order to the data lines 114 in the 2nd column, the 3rd columns, and the 4th columns in the individual blocks B5 to B8 belonging to the group A2 with the same number as the number "2" of the sampling signal S2. Thereby, the sampling of a data signal and the write-in to the pixel electrode 118 are performed on the data lines 114 in the 2nd columns, the 3rd columns, and the 4th columns of the individual blocks B5 to B8 belonging to the group A2.

Hereinafter, if a sampling signal with an odd number is set to an H level, the control signals are again set to an H level in order in order of Sel5→Sel2→Sel3→Sel4 again, and if a sampling signal with an even number is set to an H level, the control signals are again set to an H level in order of Sel1→Sel6→Sel7→Sel8. The same operations are repeated until the sampling signal S72 is set to an H level.

If the sampling signal S72 is set to an H level, the write-in to the pixels 110 in the 1st row is completed, and subsequently the same operations are repeated to the pixels in the 2nd row, the 3rd row, the 4th row, . . . , and the 864th row.

In addition, in this embodiment, since the polarity reversals in units of scanning lines are performed as described above, the data signals Vid1 to Vid4 assume negative polarity in the horizontal effective display period in which the scanning signals in the even-numbered rows are set to an H level. In this manner, the write-in of positive polarity is performed on the pixels in the odd-numbered rows, while the write-in of negative polarity is performed on the pixels in the even-numbered rows. Thereby, the write-in is completed over all the pixels in the 1st to 864th rows in this first frame.

Here, in the first frame, the relationship between the write-in in each column and elapsed time will be described with reference to FIG. 11.

As shown in this drawing, or as described above, in each horizontal effective display period of the first frame, at the 1st time, write-in to the pixels in the 17th, 21st, 25th and 29th columns is performed; at the 2nd time, write-in to the pixels in the 2nd, 6th, 10th and 14th columns is performed; at the 3rd time, write-in to the pixels in the 3rd, 7th, 11th and 15th columns is performed; at the 4th time, write-in to the pixels in the 4th, 8th, 12th and 16th columns is performed; at the 5th time, write-in to the pixels in the 33rd, 37th, 41st and 45th columns is performed; at the 6th time, write-in to the pixels in the 18th, 22nd, 26th and 30th columns is performed; at the 7th time, write-in to the pixels in the 19th, 23rd, 27th and 31st columns is performed; and, at the 8th time, write-in to the pixels in the 20th, 24th, 28th and 32nd columns is performed (the descriptions about the write-in at the 9th and subsequent times are omitted).

Here, if attention is paid to a pixel in the 17th column, for example, after the 1st write-in to the pixel in the 17th column, write-in to a pixel in the 16th column adjacent to the left of the pixel in the 17th column is performed at the 4th time, and write-in to a pixel in the 18th column adjacent to the right of the pixel in the 17th column is performed at the 6th time. Accordingly, after the write-in-in to the pixel in the 17th column, write-in to pixels adjacent thereto is performed two times.

On the other hand, if attention is paid to a pixel in the 18th column, after the 6th write-in to the pixel in the 18th column, only write-in to a pixel in the 19th column adjacent thereto is performed at the 7th time. Accordingly, after the write-in-in to the pixel in the 18th column, write-in to a pixel adjacent thereto is performed one time.

Moreover, if attention is paid to a pixel in the 20th column, after the 8th write-in to the pixel in the 20th column, write-in to a pixel adjacent thereto is already completed. Accordingly, after the write-in-in to the pixel in the 20th column, write-in to a pixel adjacent thereto is not performed.

Figure 11:
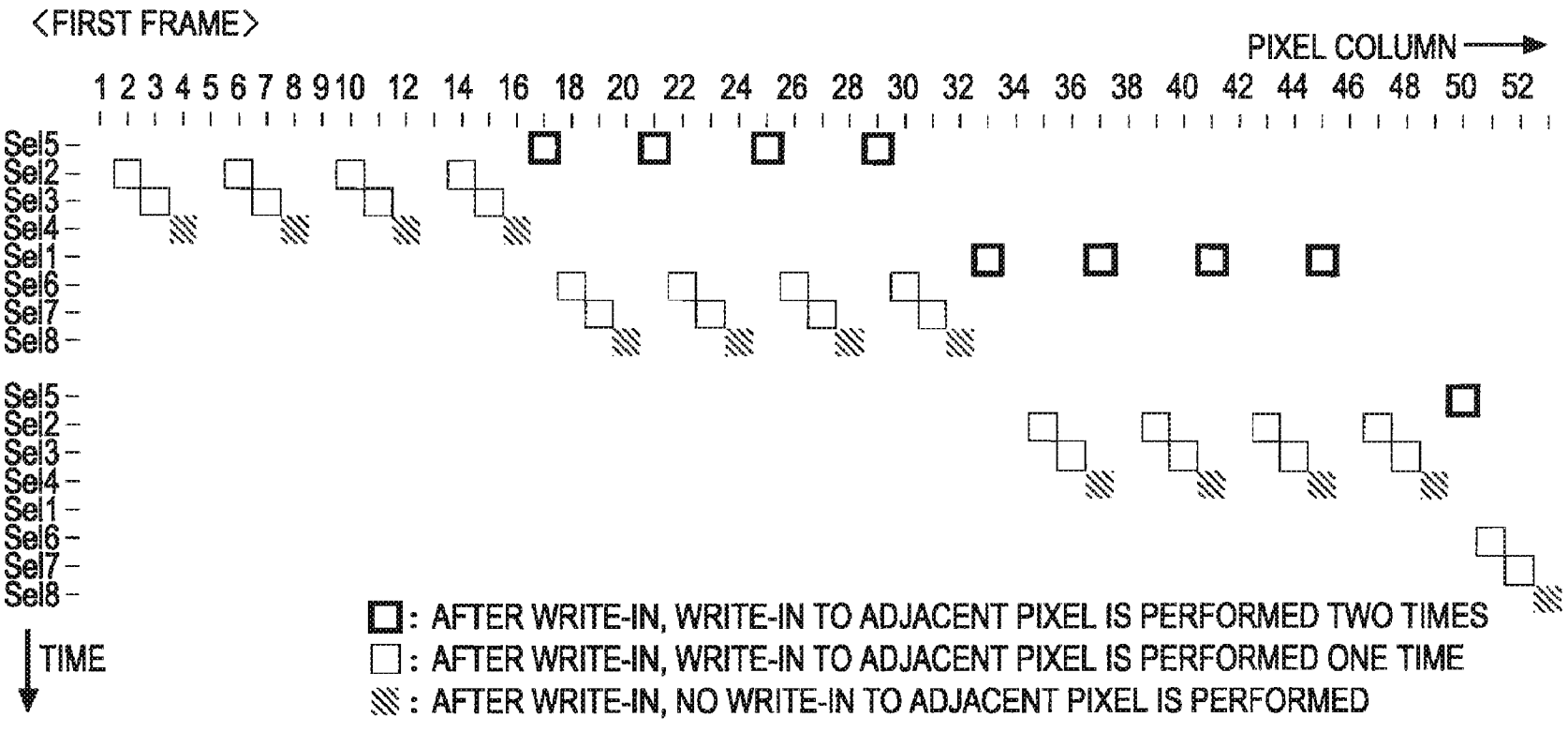
FIG. 11 is a view showing write-in states of the pixels in the first frame of the electro-optical device.

Accordingly, in the first frame, three kinds of pixels whose number of times of write-in to adjacent pixels after write-in is two, one, and zero occur, and their distribution becomes as shown in FIG. 11.

Next, the operations in second and subsequent frames will be described.

The operations in the second and subsequent frames are partially different from that in the first frame in that the order of setting the control signals Sel1 to Sel8 to an H level is altered, and the order of reading out the image data Vin from the line memory 310 following the alternation of the above setting order is altered.

Thus, the descriptions of the second and subsequent frames will be focused on these difference points.

Figure 8:
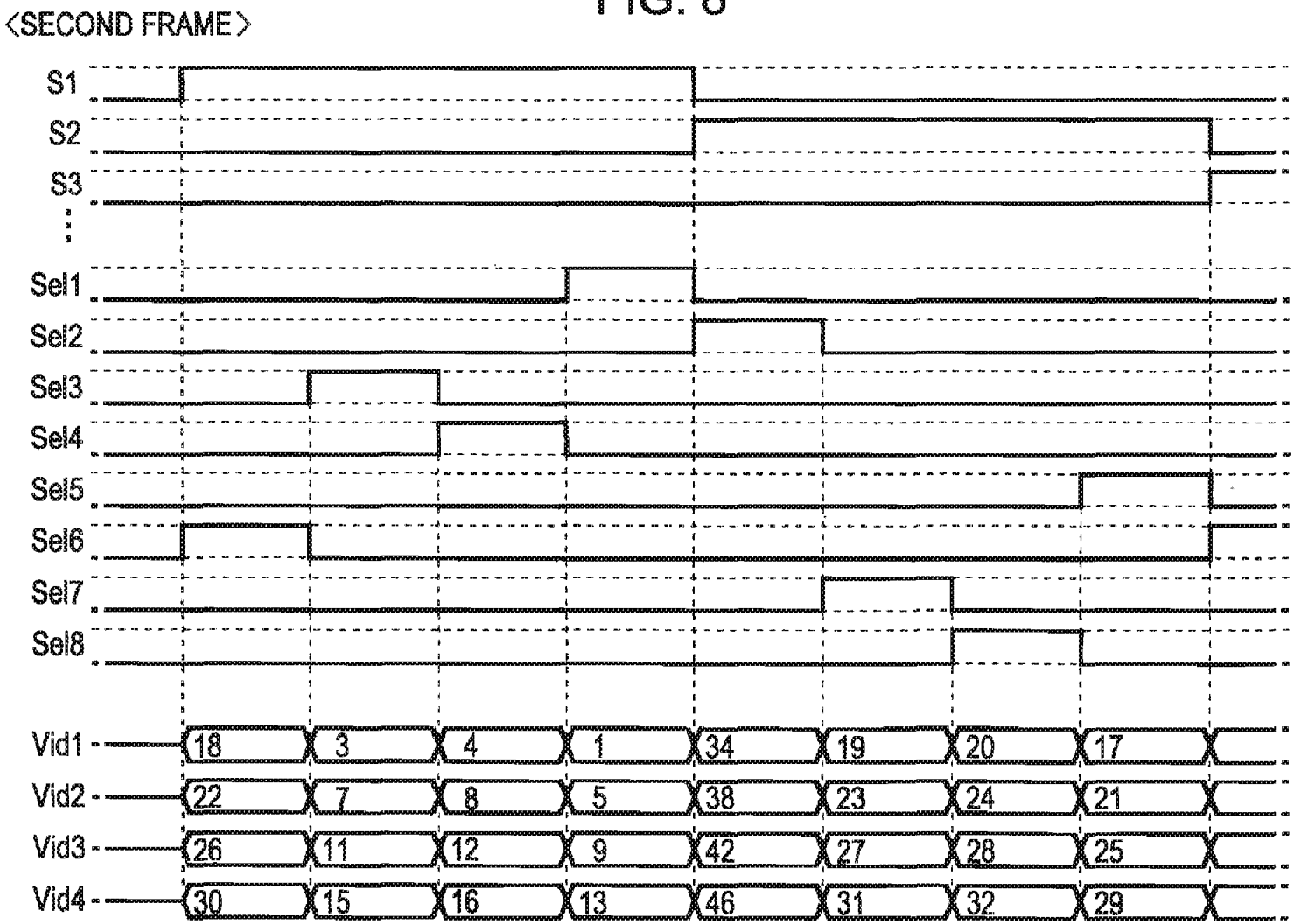
FIG. 8 is a view illustrating the operation of a second frame of the electro-optical device.

First, in the second frame, the order that the control signals Sel1 to Sel8 are set to an H level, as shown in FIG. 8, is as follows: 1st time: Sel6→2nd time: Sel3→3rd time: Sel4→4th time: Sel1 in the period in which an sampling signal with an odd number is set to an H level, and 5th time: Sel2→6th time: Sel7→7th time: Sel8→8th time: Sel5 in the period in which a sampling signal with an even number is set to an H level.

Accordingly, in the second frame, in the period in which a sampling signal of an odd number is set to an H level, sampling of data signals and write-in to the pixel electrode 118 are performed in the following order: at the 1st time, 2nd columns in individual blocks belonging to a group with a number greater by "1" than the odd number; at the 2nd time, 3rd columns in individual blocks belonging to a group with the same number as the odd number; at the 3rd time, 4th columns in individual blocks belonging to a group with the same number as the odd number; and, at the 4th time, 1st columns in individual blocks belonging to a group with the same number as the odd number. Moreover, in the second frame, in the period in which a sampling signal with an even number is set to an H level, sampling of data signals and write-in to the pixel electrode 118 are performed in the following order: at the 5th time, 2nd columns in individual blocks belonging to a group with a number greater by "1" than the even number; at the 6th time, 3rd columns in individual blocks belonging to a group with the same number as the odd number; at the 7th time, 4th columns in individual blocks belonging to a group with the same number as the even number; and at the 4th time, 1st columns in individual blocks belonging to a group with the same number as the even number.

Figure 12:
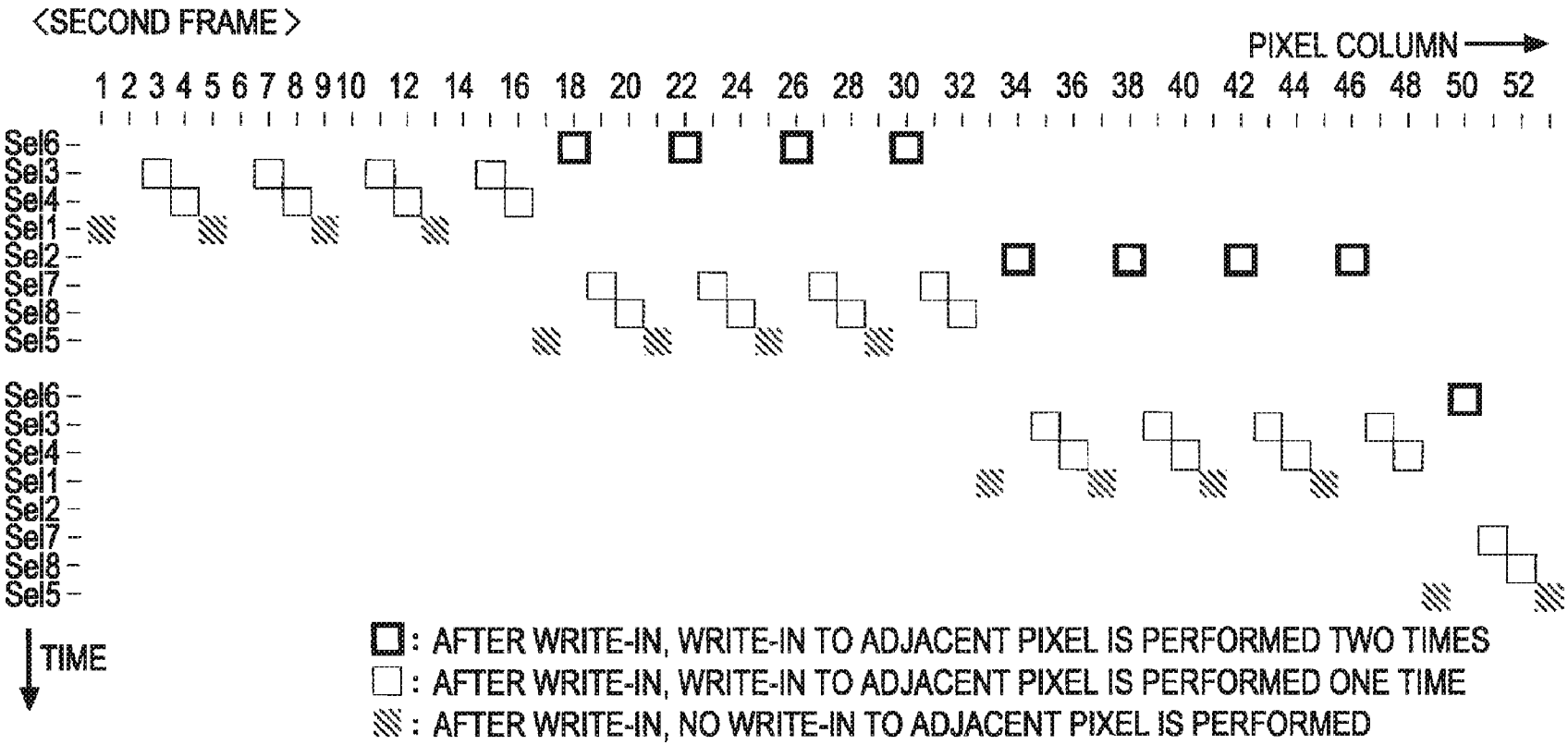
FIG. 12 is a view showing write-in states of the pixels in the second frame of the electro-optical device.

Accordingly, in the second frame, the distribution of three kinds of pixels whose number of times of write-in to adjacent pixels after write-in is two, one, and zero, becomes as shown in FIG. 12.

In addition, in the second frame, negative polarity write-in is performed in odd rows and positive polarity write-in is performed in even rows, from the viewpoint of the relationship of alternating current driving of pixels.

Figure 9:
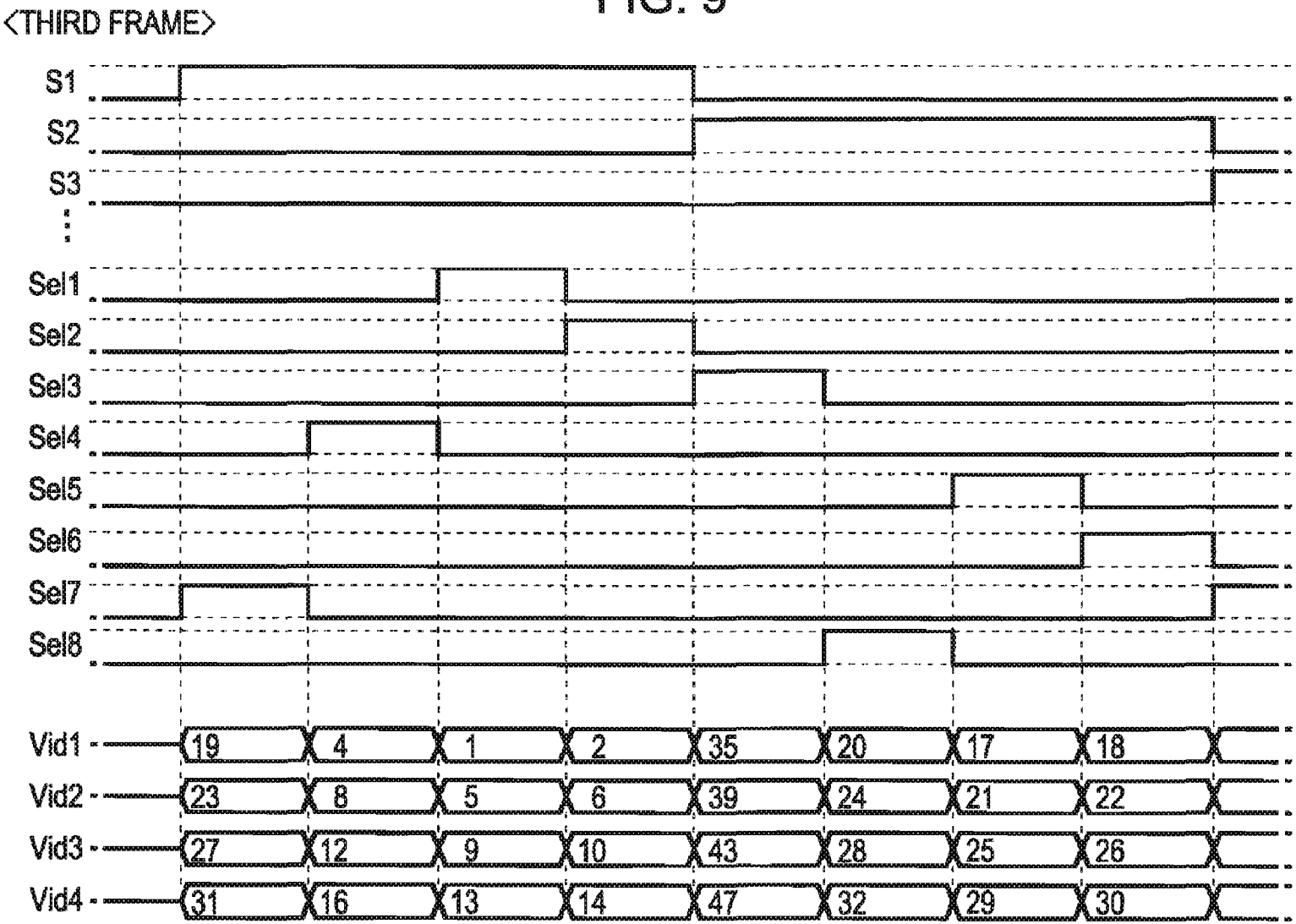
FIG. 9 is a view illustrating the operation of a third frame of the electro-optical device.

First, in the third frame, the order that the control signals Sel1 to Sel8 are set to an H level, as shown in FIG. 9, is as follows: 1st time: Sel7→2nd time: Sel4→3rd time: Sel1→4th time: Sel2 in the period in which a sampling signal with an odd number is set to an H level, and 5th time: Sel3→6th time: Sel8→7th time: Sel5→8th time: Sel6 in the period in which a sampling signal with an even number is set to an H level.

Accordingly, in the third frame, in the period in which a sampling signal of an odd number is set to an H level, sampling of data signals and write-in to the pixel electrodes 118 are performed in the following order: at the st time; 3rd columns in individual blocks belonging to a group with a number greater by "1" than the odd number; at the 2nd time, 4th columns in individual blocks belonging to a group with the same number as the odd number; at the 3rd time, 1st columns in individual blocks belonging to a group with the same number as the odd number; and, at the 4th time, 2nd columns in individual blocks belonging to a group with the same number as the odd number. Moreover, in the third frame, in the period in which a sampling signal with an even number is set to an H level, sampling of data signals and write-in to the pixel electrodes 118 are performed in the following order: at the 5th time, 3rd columns in individual blocks belonging to a group with a number greater by "1" than the even number; at the 6th time, 4th columns in individual blocks belonging to a group with the same number as the even number; at the 7th time, 1st columns in individual blocks belonging to a group with the same number as the even number; and at the 8th time, 2nd columns in individual blocks belonging to a group with the same number as the even number.

Figure 13:
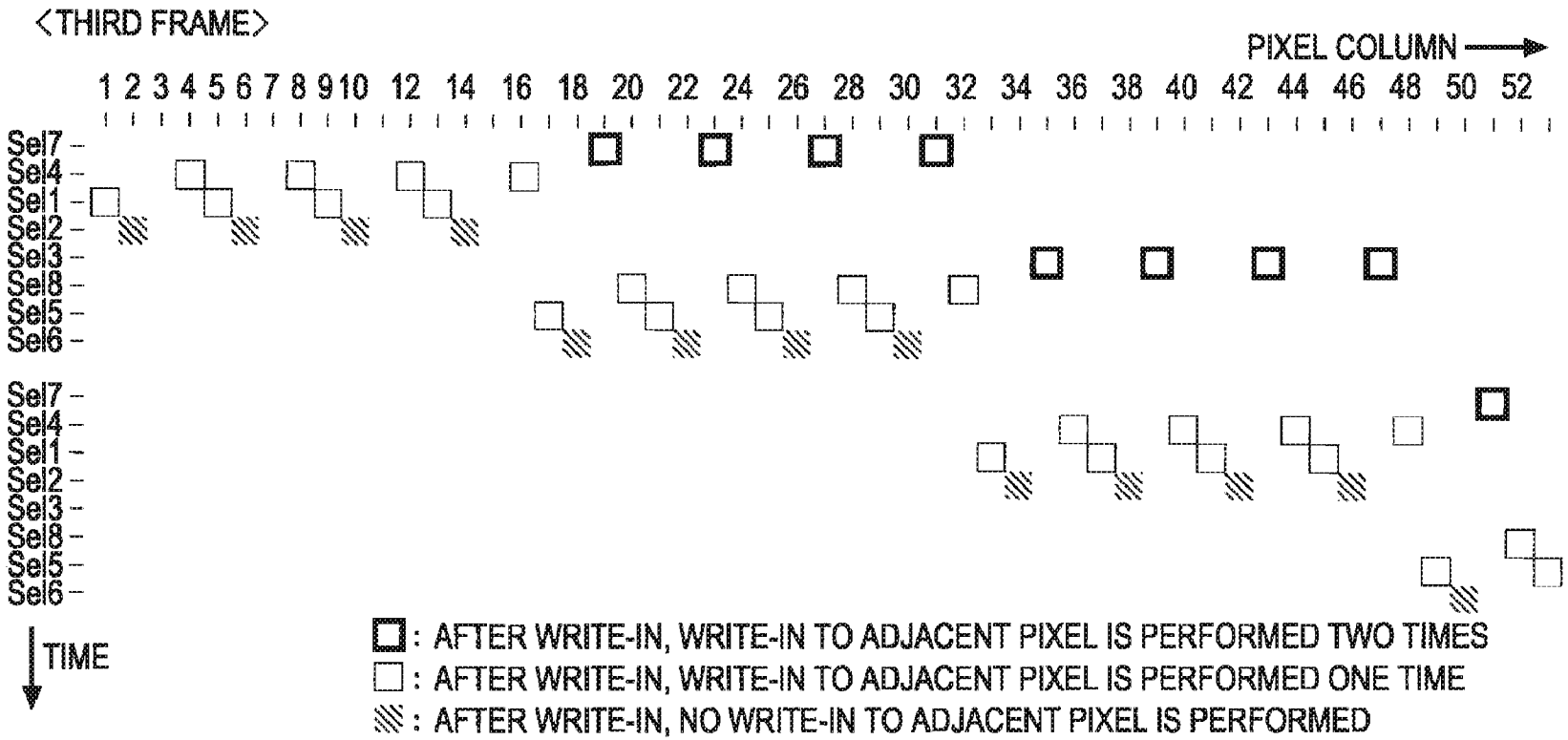
FIG. 13 is a view showing write-in states of the pixels in the third frame of the electro-optical device.

Accordingly, in the third frame, the distribution of three kinds of pixels whose number of times of write-in to adjacent pixels after write-in is two, one, and zero, becomes as shown in FIG. 13.

In addition, in the third frame, positive polarity write-in is again performed in odd rows and negative polarity write-in is again performed in even rows, from the viewpoint of the relationship of alternating current driving of pixels.

Figure 10:
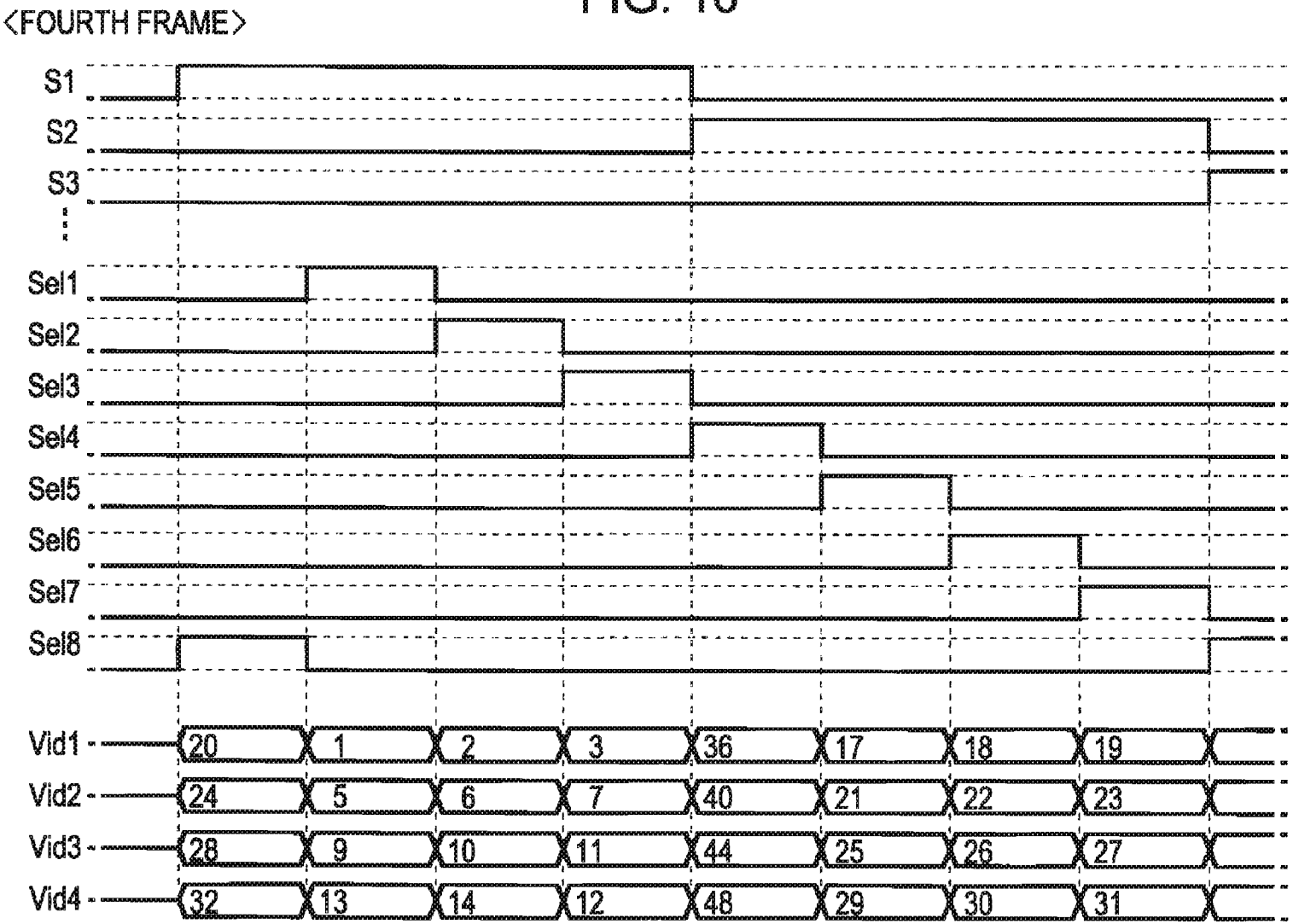
FIG. 10 is a view illustrating the operation of a fourth frame of the electro-optical device.

First, in the fourth frame, the order that the control signals Sel1 to Sel8 are set to an H level, as shown in FIG. 10, is as follows: 1st time: Sel8→2nd time: Sel1→3rd time: Sel2→4th time: Sel3 in the period in which a sampling signal with an odd number is set to an H level, and 5th time:

Sel4→6th time: Sel5→7th time: Sel6×8th time: Sel6 in the period in which a sampling signal with an even number is set to an H level.

Accordingly, in the fourth frame, in the period in which a sampling signal of an odd number is set to an H level, sampling of data signals and write-in to the pixel electrodes 118 are performed in the following order: at the 1st time, 4th columns in individual blocks belonging to a group with a number greater by "1" than the odd number; at the 2nd time, 1st columns in individual blocks belonging to a group with the same number as the odd number; at the 3rd time, 2nd columns in individual blocks belonging to a group with the same number as the odd number; and, at the 4th time, 3rd columns in individual blocks belonging to a group with the same number as the odd number. Moreover, in the fourth frame, in the period in which a sampling signal with an even number is set to an H level, sampling of data signals and write-in to the pixel electrodes 118 are performed in the following order: at the 5th time, 4th columns in individual blocks belonging to a group with a number greater by "1" than the even number; at the 6th time, 1st columns in individual blocks belonging to a group with the same number as the even number; at the 7th time, 2nd columns in individual blocks belonging to a group with the same number as the even number; and at the 8th time, 3rd columns in individual blocks belonging to a group with the same number as the even number.

Figure 14:
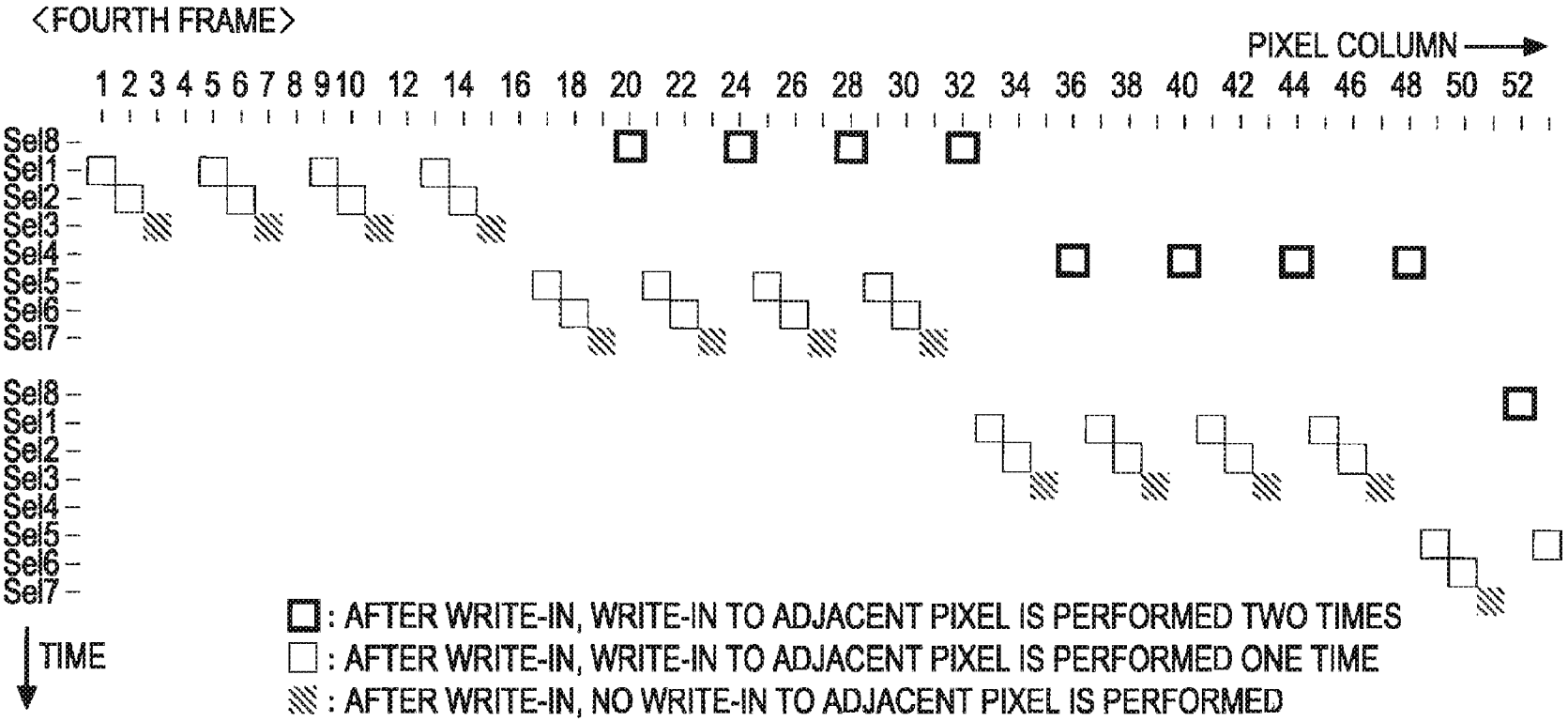
FIG. 14 is a view showing write-in states of the pixels in the fourth frame of the electro-optical device.
Figure 15:
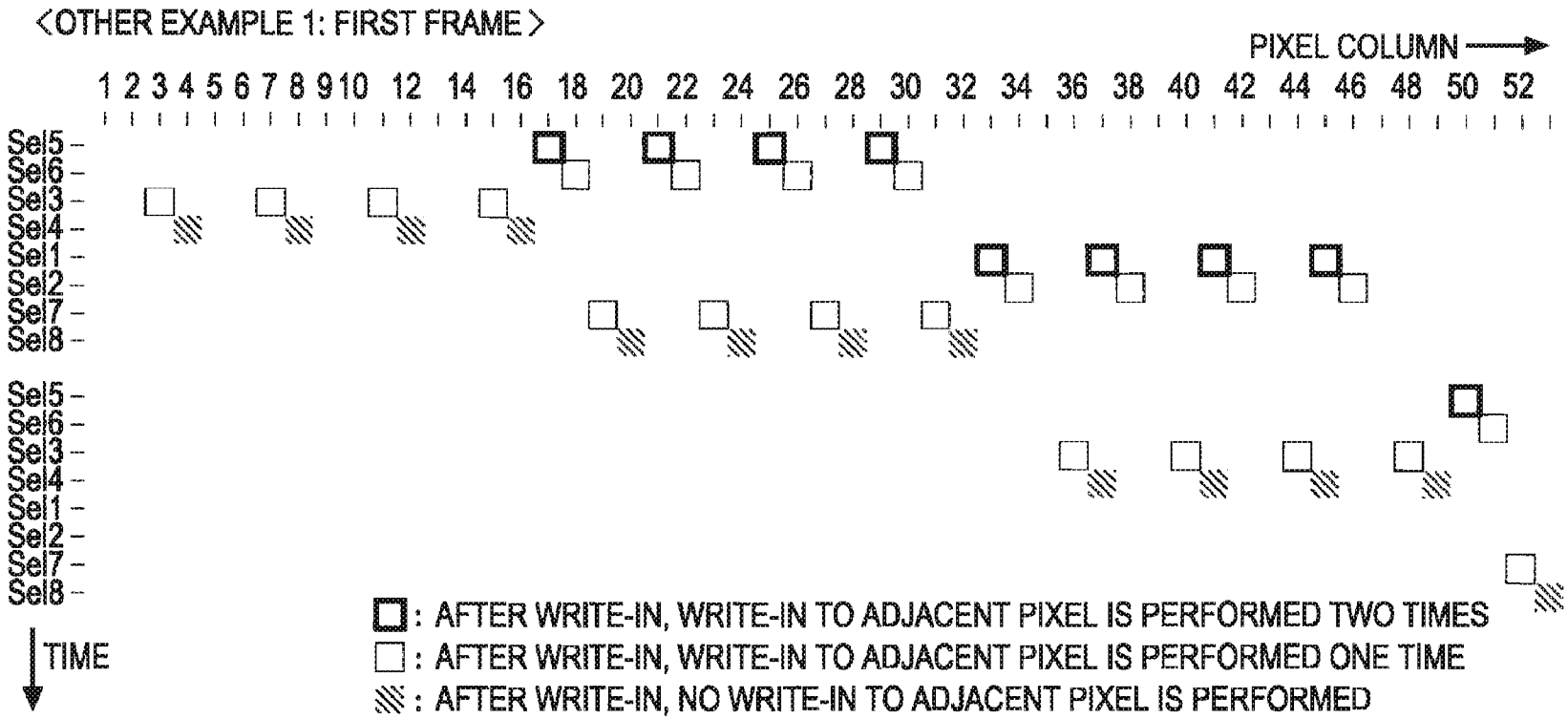
FIG. 15 is a view showing write-in states of the pixels in a first frame of other example 1.
Figure 16:
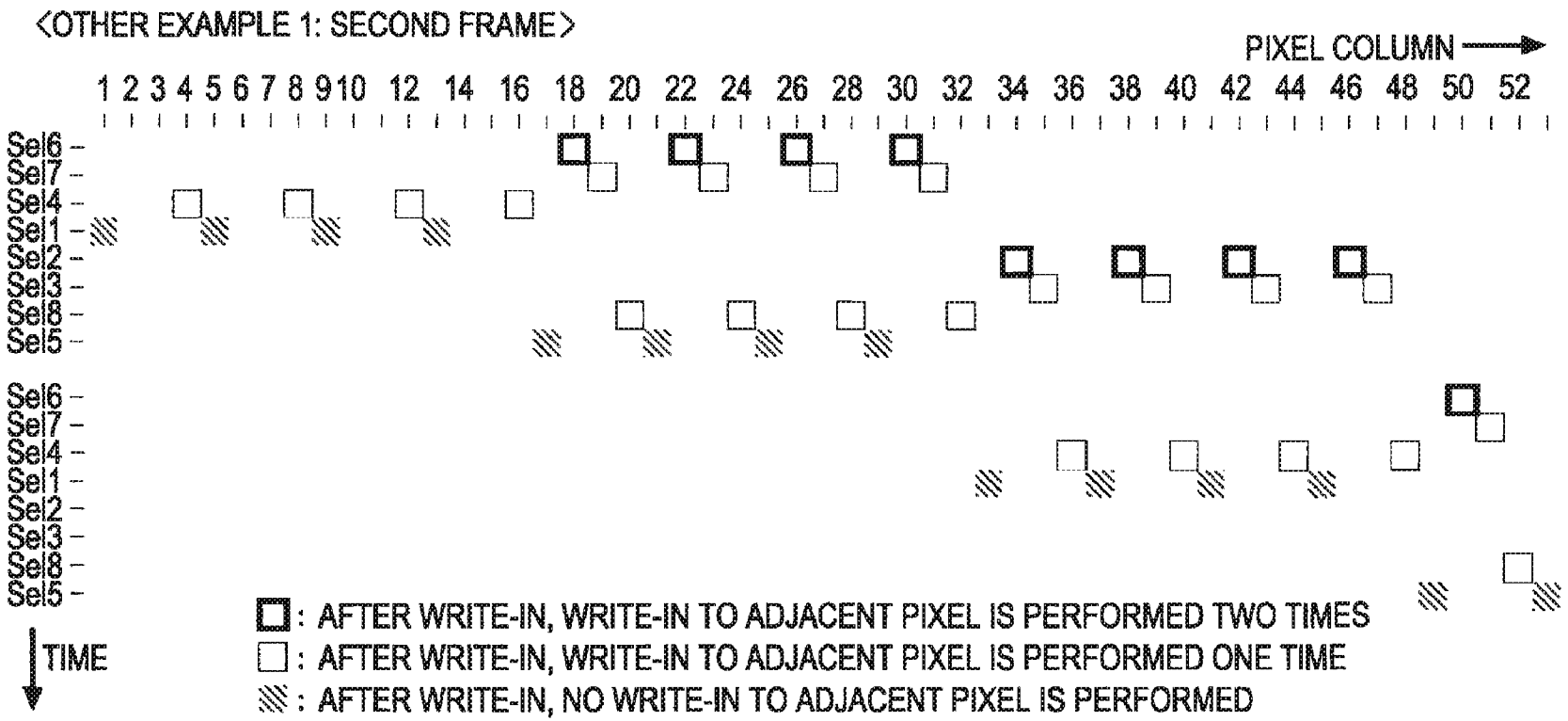
FIG. 16 is a view showing write-in states of the pixels in a second frame of other example 1.
Figure 17:
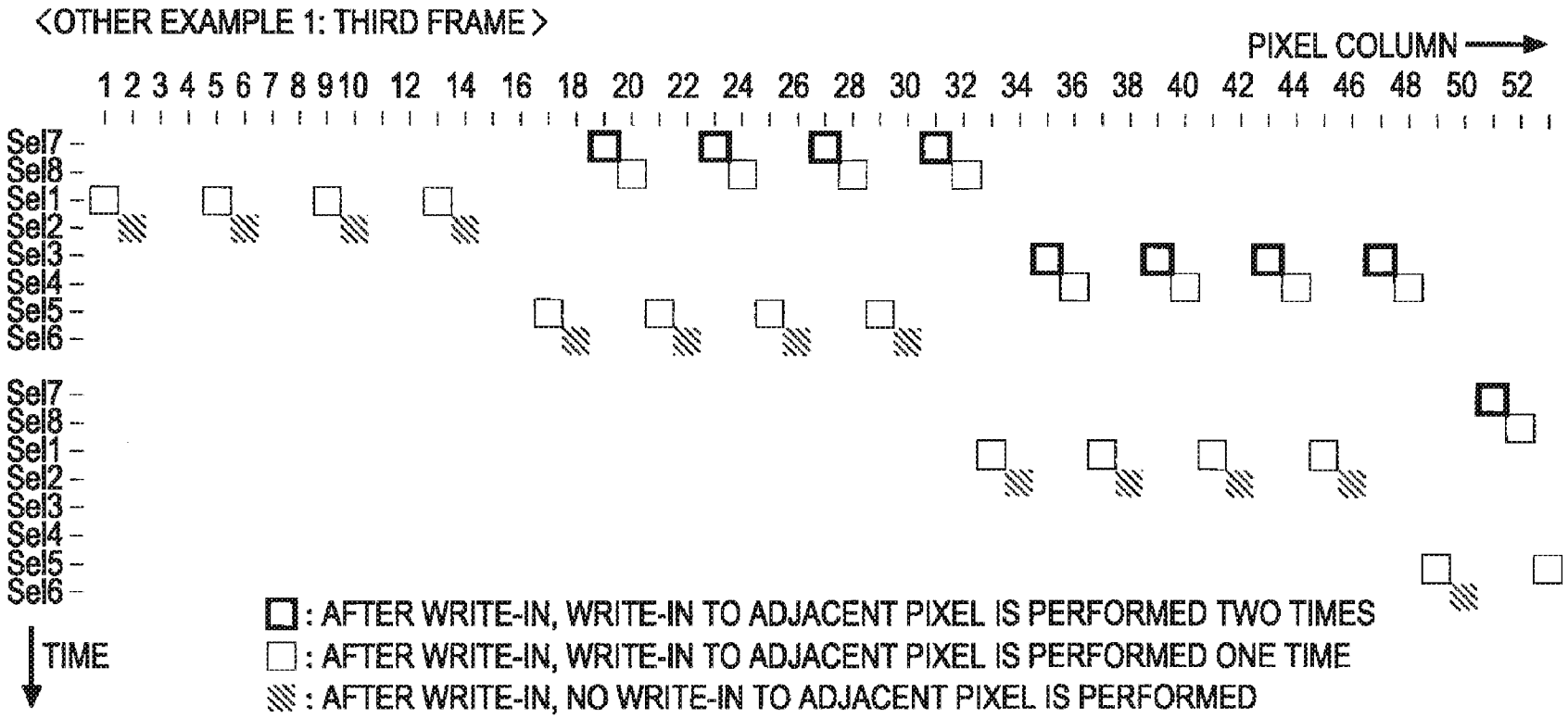
FIG. 17 is a view showing write-in states of the pixels in a third frame of other example 1.
Figure 18:
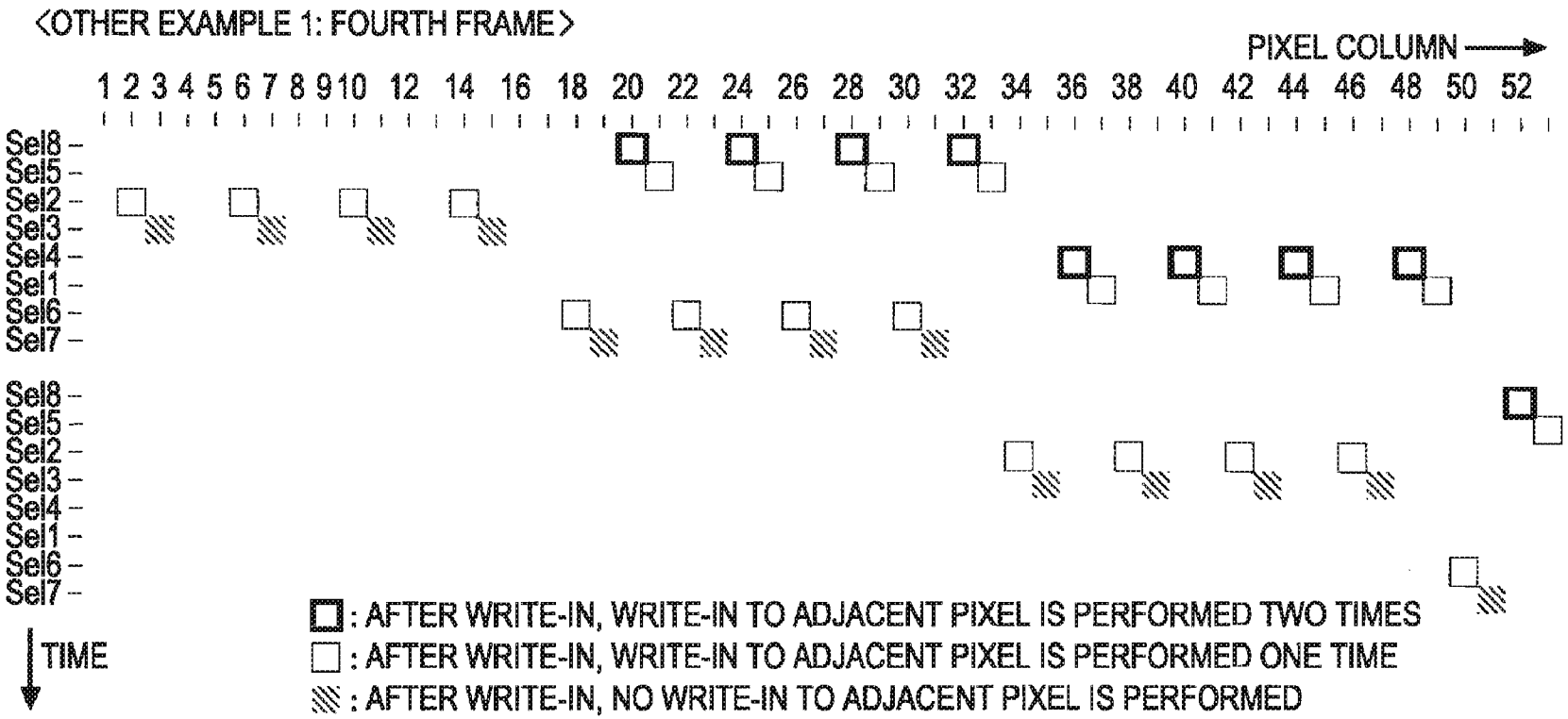
FIG. 18 is a view showing write-in states of the pixels in a fourth frame of other example 1.

Accordingly, in the fourth frame, the distribution of three kinds of pixels whose number of times of write-in to adjacent pixels after write-in is two, one, and zero, becomes as shown in FIG. 14.

In addition, in the fourth frame, negative polarity write-in is again performed in odd rows and positive polarity write-in is again performed in even rows, from the viewpoint of the relationship of alternating current driving of pixels. Moreover, after the fourth frame, the processing returns to the first frame.

Meanwhile, since a scanning signal to be supplied to any scanning line is at an H level in the horizontal effective display period, the TFTs 116 of the pixels 110 corresponding to the scanning line are in an ON state. Therefore, as far as the horizontal effective display period is concerned, even after the sampling as well as at a point of time when data signals are sampled to the data lines 114, a potential fluctuation in the data lines 114 becomes a direct cause of changing the grayscale of the pixels 110.

On the other hand, since the data lines 114 are close to each other as well as a capacitance is parasitized on all the data lines 114 in the display panel 100, they are capacitively coupled together. Therefore, although the voltage of a data signal is properly held at the time when a data signal has been sampled to a certain data line (at the time of write-in), if another data signal is sampled to a data line adjacent to the data line concerned after the sampling to the data line concerned, a voltage change in the sampling may affect the data line concerned to change the voltage of the data signal sampled at the beginning.

Therefore, after a data signal is sampled to a certain noticing data line in a horizontal effective display period, when a data signal is sampled to a data line adjacent to the noticing data line, the voltage of the noticing data line may change and the grayscale of a pixel corresponding to an intersection of the noticing data line and a scanning line being selected may change beyond a value targeted at the beginning.

In this embodiment, when being viewed only from any one frame among the first frame (FIG. 11) to the fourth frame (FIG. 14), individual pixels in the 17th column (from the 17th column up to 1136th column) related to the effective display region includes three kinds of pixels, i.e., a pixel whose number of times of write-in to an adjacent pixel after the write-in becomes two, a pixel whose number of times of write-in to an adjacent pixel after the write-in becomes one, and a pixel whose number of times of write-in to an adjacent pixel after the write-in becomes zero, voltage fluctuation occurs and display unevenness occurs due to a difference in the number of times of write-in to an adjacent pixel when being viewed from any one frame.

However, as the frames from the first frame to the fourth frame are sequentially cycled, as for individual pixels related to the effective display region, in any one frame, the number of times of write-in to an adjacent pixel after the write-in becomes two; in other two frames, the number of times of write-in to an adjacent pixel after the write-in becomes one; and in the one remaining frame, the number of times of write-in to an adjacent pixel after the write-in becomes zero. Accordingly, in each pixel related to the effective display region, the conditions (conditions after sampling) after write-in to each pixel (data line) are satisfied in this embodiment, when four frames are defined as one cycle. Thus, display unevenness are hardly recognized visually.

In addition, the pixels in the 1st to 16th columns and the 1137th to 1152nd columns (not shown in FIGS. 11 to 14) do not satisfy the conditions in other pixels when four frames are defined as one cycle. Therefore, this embodiment is configured such that the pixels in the 1st to 16th columns and the 1137th to 1152nd columns serve as dummy pixels to shild light.

Other Example 1 of First Embodiment

In the first embodiment, the order that the control signals Sel1 to Sel8 are set to an H level, i.e., that is, the order that columns in individual blocks belonging to adjacent groups are selected are selected is as follows:

in the first frame, 1st time: Sel5→2nd time: Sel2→3rd time: Sel3→4th time: Sel4→5th time: Sel1→6th time: Sel6→7th time: Sel7→8th time: Sel8;

in the second frame, 1st time: Sel6→2nd time: Sel3→3rd time: Sel→4th time: Sel1→5th time: Sel2→6th time: Sel7→7th time: Sel8→8th time: Sel5;

in the third frame, 1st time: Sel7→2nd time: Sel4→3rd time: Sel1→4th time: Sel2→5th time: Sel3→6th time: Sel8→7th time: Sel5→8th time: Sel6; and, in the fourth frame, 1st time: Sel8→2nd time: Sel1→3rd time: Sel2→4th time: Sel3→5th time: Sel4→6th time: Sel5→7th time: Sel6→8th time: Sel7. However, the above order is not limited thereto but may also be the following order.

That is, by exchanging the 2nd time and the 6th time with each other in each frame, the above order may be the following order: in the first frame, 1st time: Sel5→2nd time: Sel6→3rd time: Sel3→4th time: Sel4→5th time: Sel1→6th time: Sel2→7th time: Sel7→8th time: Sel8; in the second frame, 1st time: Sel6→2nd time: Sel7→3rd time: Sel4→4th time: Sel1→5th time: Sel2→6th time: Sel3→7th time: Sel8→8th time: Sel5; in the third frame, 1st time: Sel7→2nd time: Sel8→3rd time: Sel1→4th time: Sel2→5th time: Sel2→6th time: Sel4→7th time: Sel5→8th time: Sel6; and, in the fourth frame, 1st time: Sel8→2nd time: Sel5→3rd time: Sel2→4th time: Sel3→5th time: Sel4→0th time: Sel1→7th time: Sel6→8th time: Sel7.

In addition, it cannot be overemphasized that the scanning control circuit 52 changes the read-out order of the image data Vin from the line memory 310 in accordance with alteration to this order.

When the 2nd time and the 6th time are exchanged with each other in each frame in this manner, the distribution of three kinds of pixels whose number of times of write-in to adjacent pixels after write-in is two, one, and zero, becomes as shown in FIGS. 15 to 18, respectively, from the first frame to the fourth frame.

As can also be understood from these drawings, since the write-in (sampling) conditions about each pixel (data line) related to the effective display region are satified similarly to the above even when the 2nd time and the 6th time are exchanged with each other in each frame, display unevenness can be hardly recognized visually.

Other Example 2 of Second Embodiment

That is, by exchanging the 2nd time and the 6th time with each other and exchanging the 3rd time and the 7th time with each other in each frame, the above order may be the following order:

in the first frame, 1st time: Sel5→2nd time: Sel6→3rd time: Sel7→4th time: Sel4→5th time: Sel1→6th time: Sel2→7th time: Sel3→8th time: Sel8;

in the second frame, 1st time: Sel6→2nd time: Sel7→3rd time: Sel8→4th time: Sel1→5th time: Sel2×6th time: Sel3→7th time: Sel4→8th time: Sel5;

in the third frame, 1st time: Sel7→2nd time: Sel8→3rd time: Sel5→4th time: Sel2→5th time: Sel3→6th time: Sel4→7th time: Sel1→8th time: Sel6; and, in the fourth frame, 1st time: Sel8×2nd time: Sel5→3rd time: Sel6×4th time: Sel3→5th time: Sel4→6th time: Sel1→7th time: Sel2→8th time: Sel7.

Figure 19:
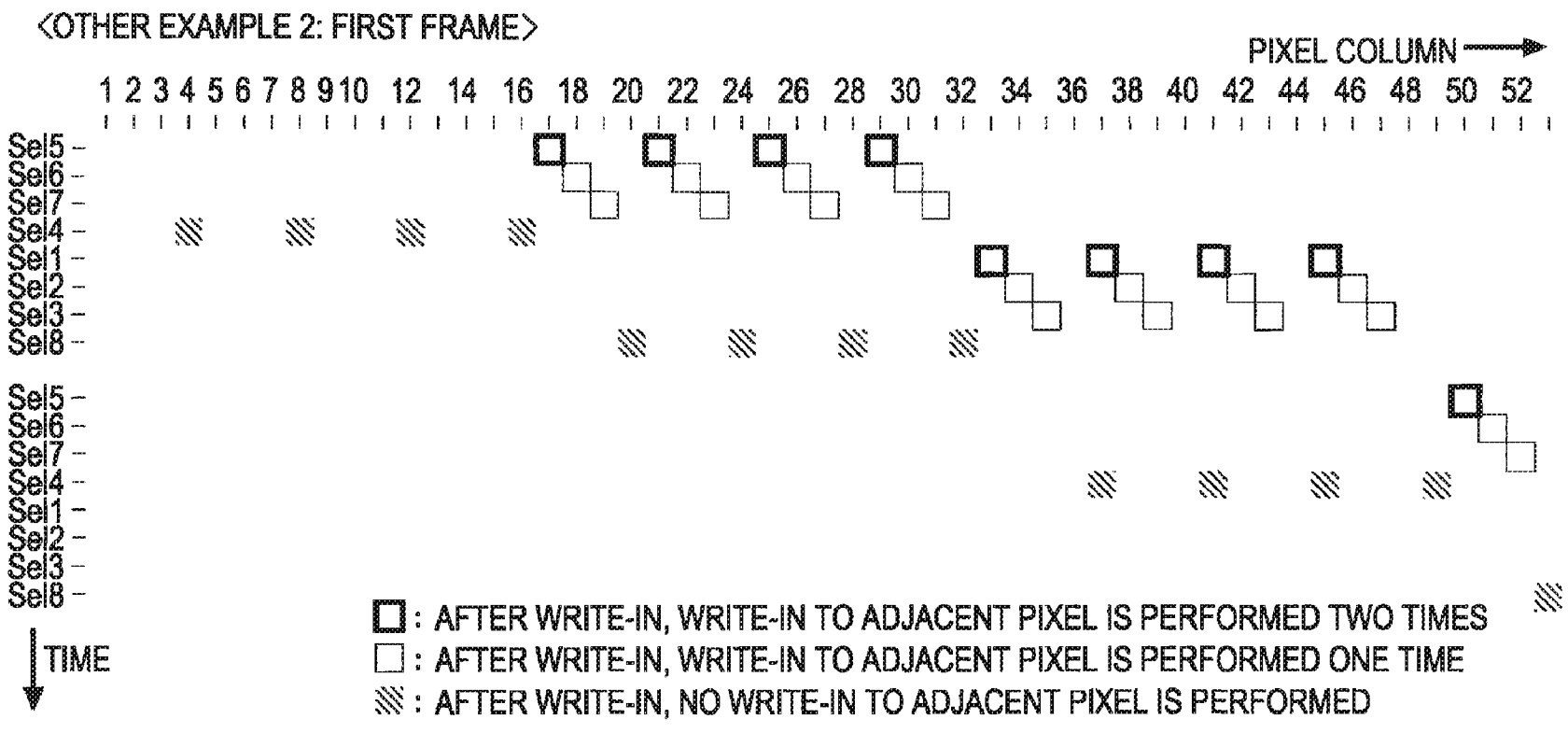
FIG. 19 is a view showing write-in states of the pixels in a first frame of other example 2.
Figure 20:
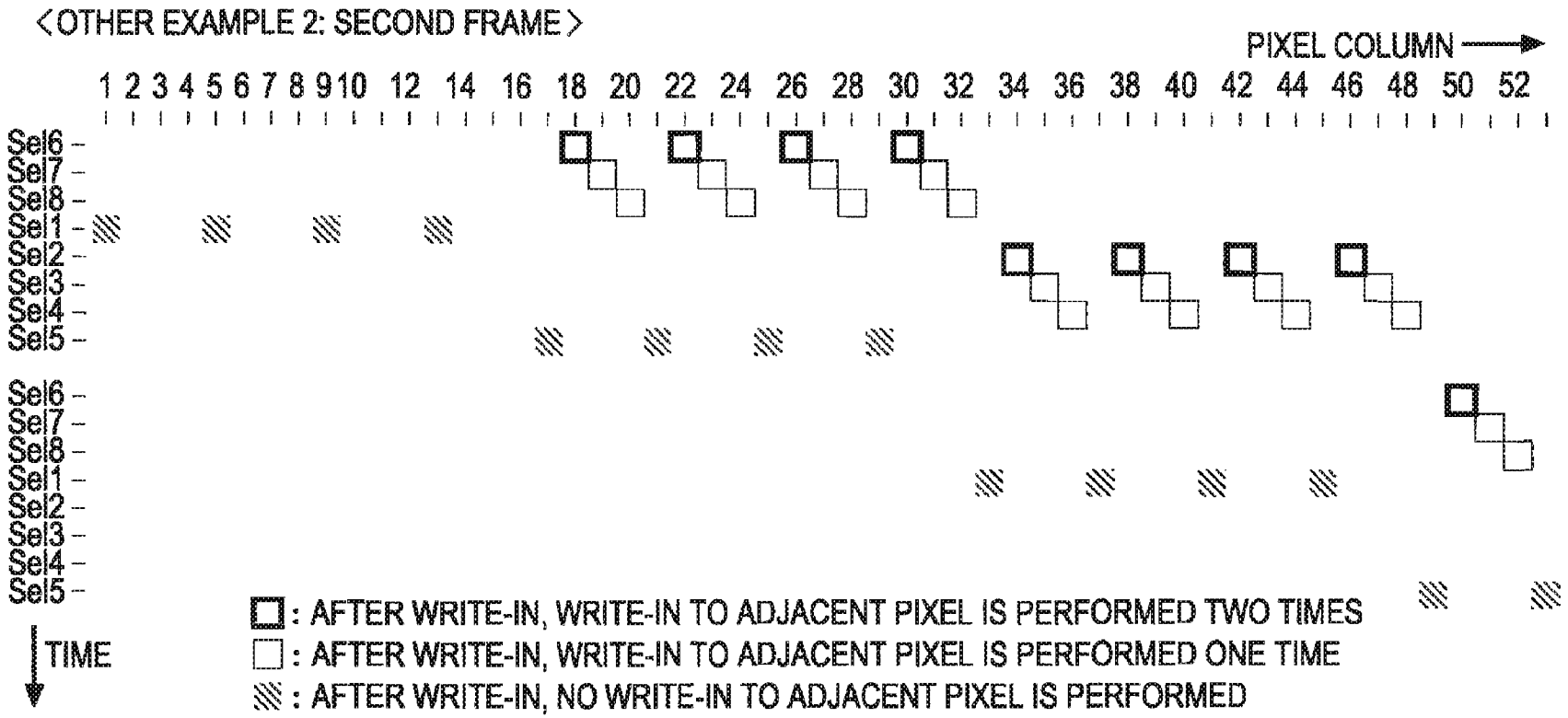
FIG. 20 is a view showing write-in states of the pixels in a second frame of other example 2.
Figure 21:
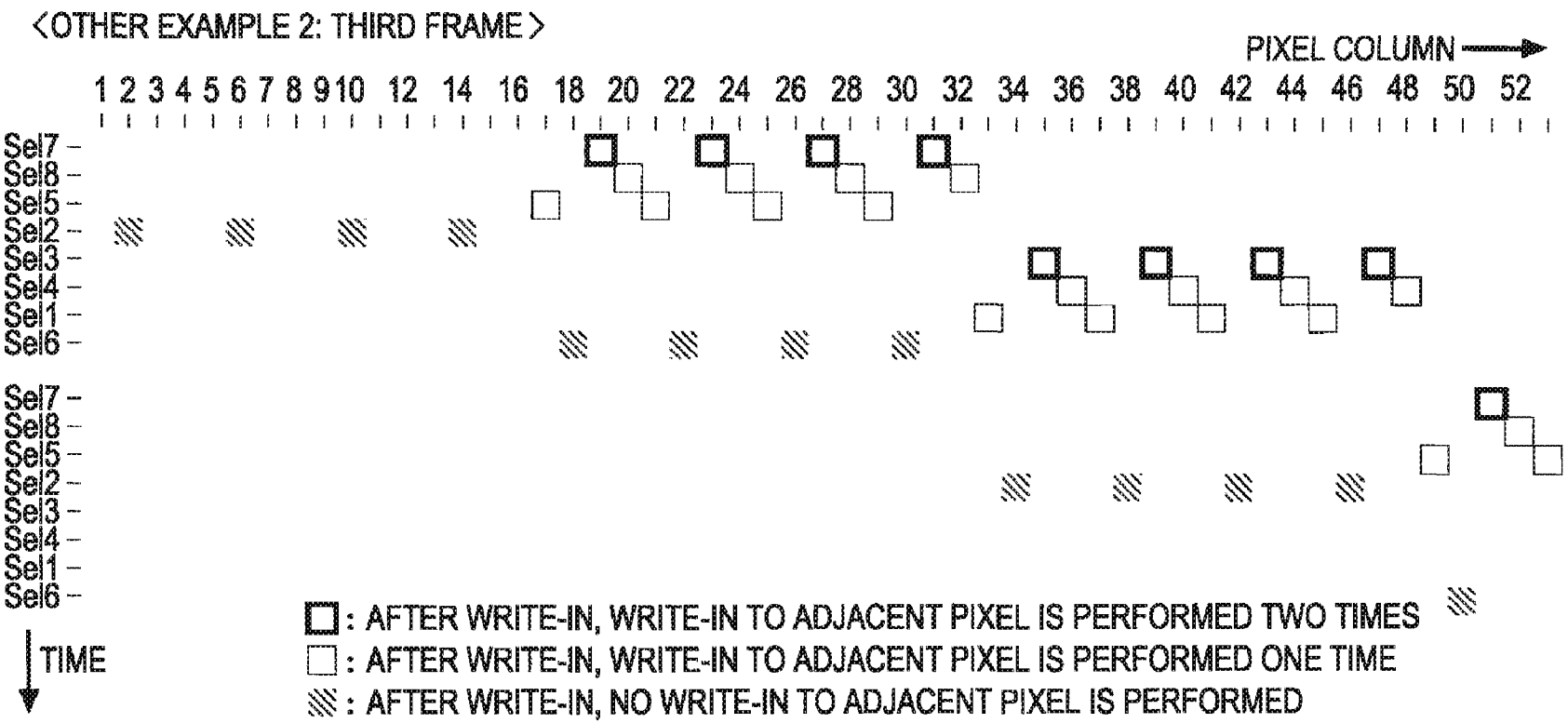
FIG. 21 is a view showing write-in states of the pixels in a third frame of other example 2.
Figure 22:
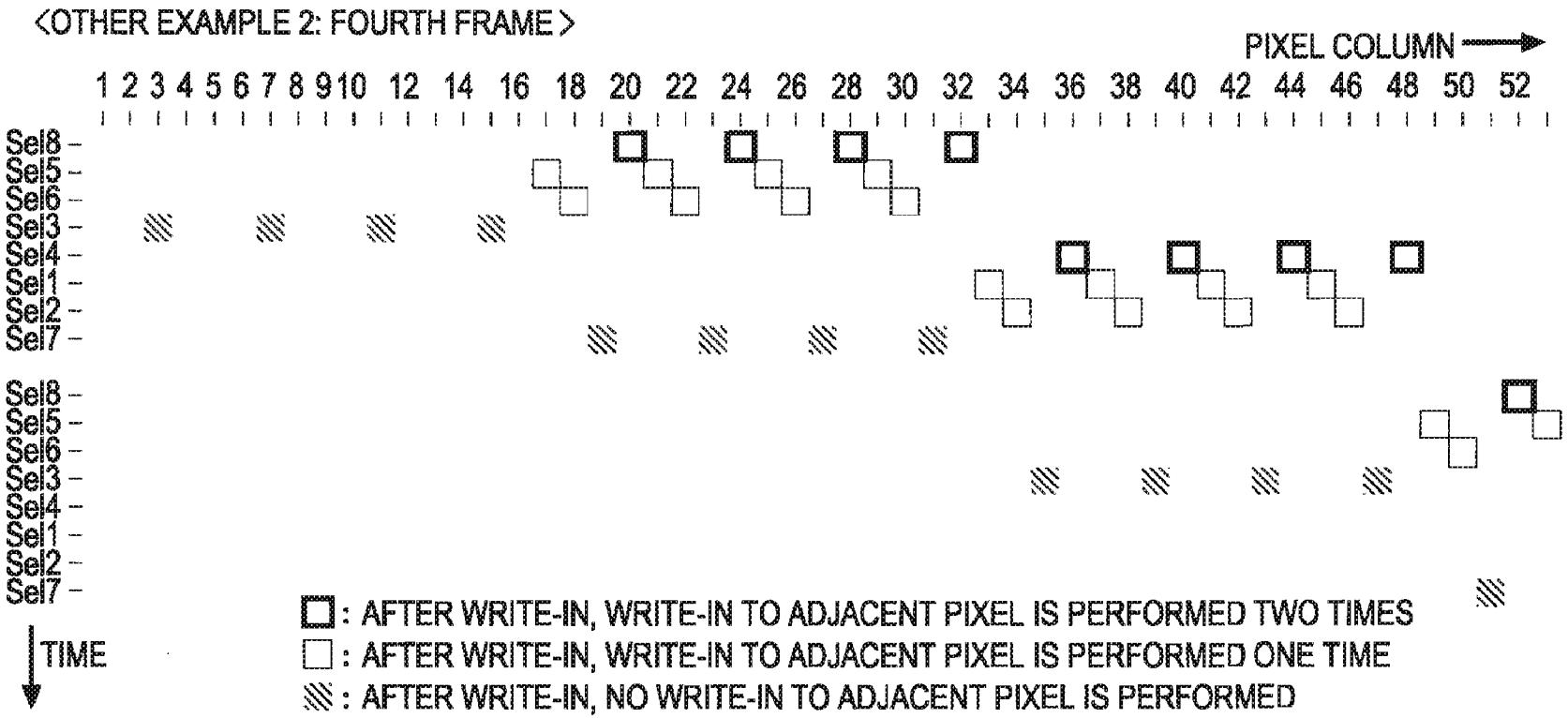
FIG. 22 is a view showing write-in states of the pixels in a fourth frame of other example 2.

When the 2nd time and the 6th time are exchanged with each other and the 3rd time and the 7th time are exchanged with each other in each frame in this manner, the distribution of three kinds of pixels whose number of times of write-in to adjacent pixels after write-in is two, one, and zero, becomes as shown in FIGS. 19 to 12, respectively, from the first frame to the fourth frame.

As can also be understood from these drawings, since the write-in (sampling) conditions about each pixel (data line) related to the effective display region are satisfied similarly to the above even when the 2nd time and the 6th time are exchanged with each other and the 3rd time and the 7th time are exchanged with each other in each frame, display unevenness can be hardly recognized visually.

Second Embodiment

Next, an electro-optical device (m=3, n=4) according to a second embodiment of the invention will be described.

Figure 23:
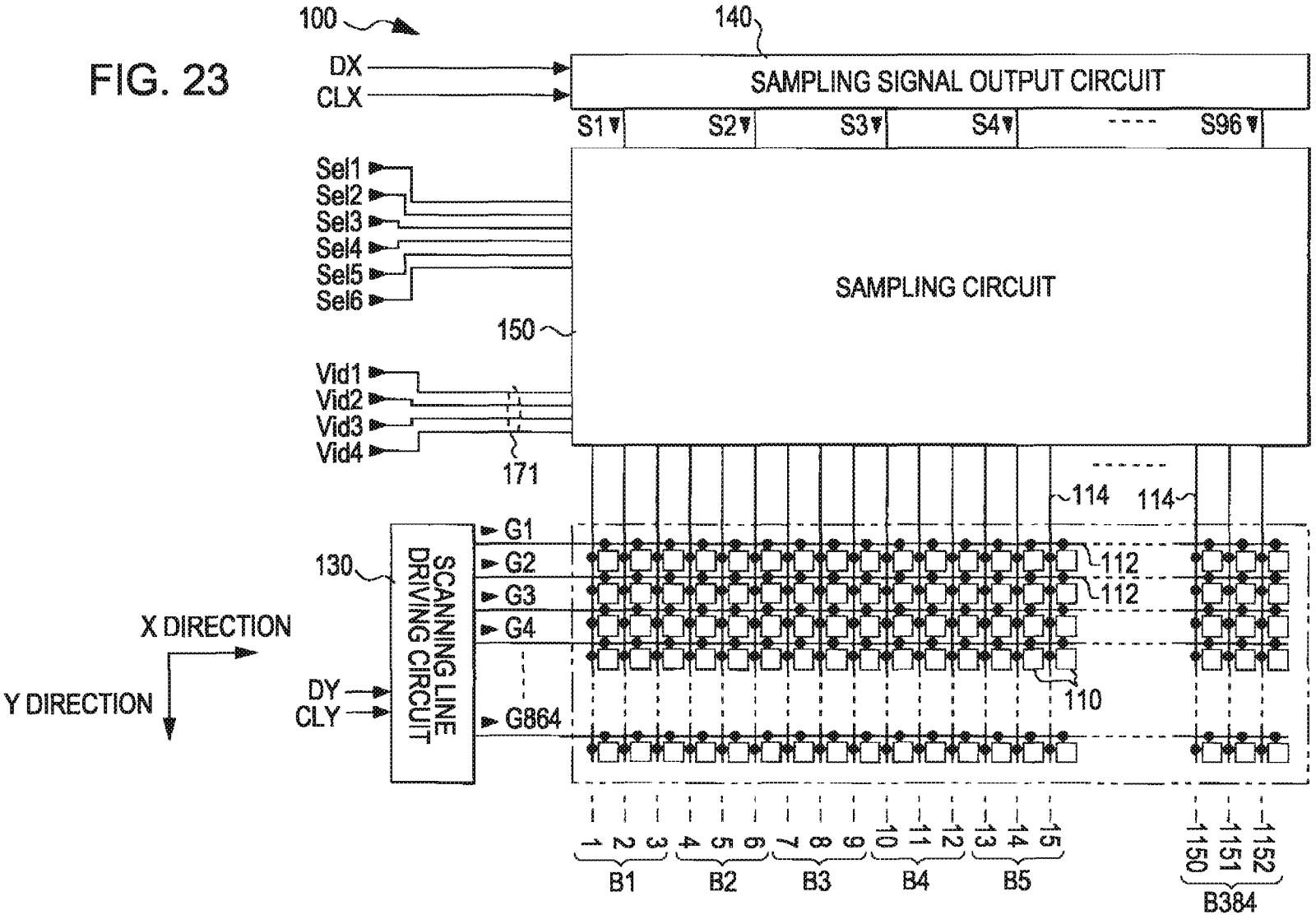
FIG. 23 is a view showing a display panel of an electro-optical device according to a second embodiment of the invention.
Figure 24:
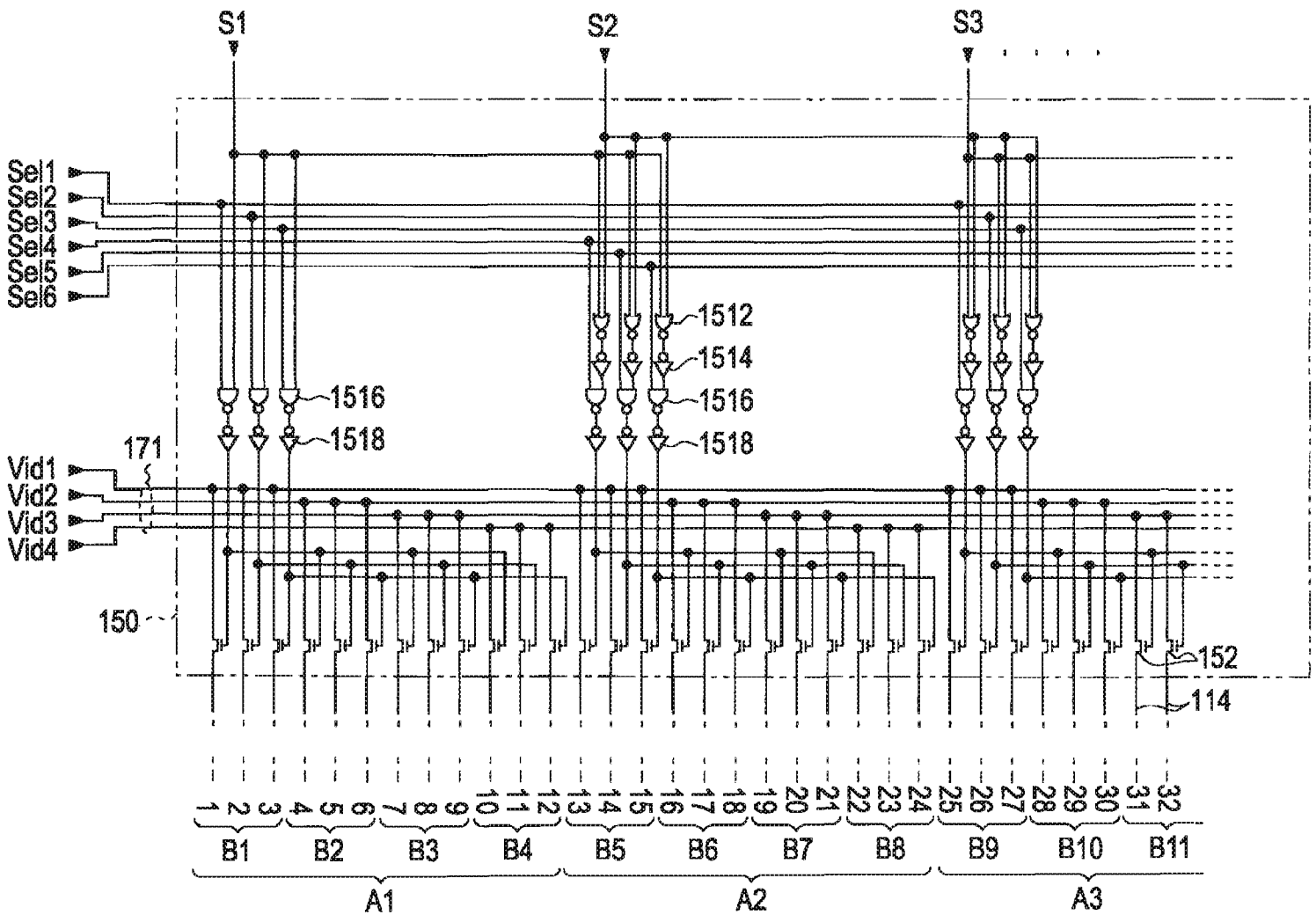
FIG. 24 is a view showing a configuration around a sampling circuit in the display panel.

In this second embodiment, the control signals Sel1 to Sel6 are adopted in the display panel 100 as shown in FIG. 23, and the sampling circuit 150 is configured as shown in FIG. 24. Moreover, in the second embodiment, the scanning control circuit 52 outputs the control signals Sel1 to Sel6, as shown on the left in parentheses of FIG. 1.

Now, as shown in FIGS. 23 and 24, the second embodiment differs in blocks and groups from the first embodiment. In addition, in the second embodiment, the data lines 114 of 1152 columns are blocked every three columns. Therefore, 1st, 2nd, 3rd, . . . , and 384th blocks when being numbered from the left are denoted by B1, B2, B3, . . . , and B384, respectively.

In addition, as shown in FIG. 24, grouping is the same as that of the first embodiment in that the grouping is performed every four blocks. In addition, in the second embodiment, since blocks to a block B384 exists, though not shown in FIG. 24, groups to a group A96 also exist. The second embodiment is the same as the first embodiment in that each of the groups A2 to A96 except the group A1 corresponds to a sampling signal with the same number as each group number and a sampling signal with a number lower by one than the group number, and the group A1 corresponds to only the sampling signal S1.

The connecting relation of the sources of the TFTs 152 is the same as that of the first embodiment. That is, referring to FIG. 24, the sources of the TFTs 152 belonging to the blocks B5, B5, B9, . . . , and B381 are connected to a first image signal line 171 to which the data signal Vid1 is supplied. Similarly, the sources of the TFTs 152 belonging to the blocks B2, B6, B10, . . . , and B382 are connected to a second Image signal line 171 to which the data signal Vid2 is supplied, the sources of the TFTs 152 belonging to the blocks B3, B7, B11, . . . , and B383 are connected to a third image signal line 171 to which the data signal Vid3 is supplied, and the sources of the TFTs 152 belonging to the blocks B4, B8, B12, . . . , and B384 are connected to a fourth image signal line 171 to which the data signal Vid4 is supplied.

Moreover, the second embodiment is the same as the first embodiment in that the gates of the TFTs 152 in the same columns in individual blocks belonging to the same group are connected in common.

Here, the gate signals supplied to the TFTs 152 are divided into even-numbered groups and odd-numbered groups, and has the following relationship.

That is, each of the even-numbered groups (A2, A4, A6, . . . , and A96) is provided with three circuit sets corresponding to the control signals Sel4 to Sel6. Each of the three circuit sets is composed of a NOR circuit 1512 which outputs a NOR signal between correponding sampling signals, a NOT circuit 1514 which outputs a NOT signal of the NOR signal, a NAND circuit 1516 which outputs a NAND signal of the NOT signal and any one of the control signals Sel4 to Sel6, and a NOT circuit 1518 which outputs a NOT signal of the NAND signal.

Among them, the NOT signal of the NOT circuit 1518 output corresponding to the control signal Sel4 becomes gate signals of the TFTs 152 corresponding to 1st columns in individual blocks belonging to an even-numbered group. Similarly, the NOT signal of the NOT circuit 1518 output corresponding to the control signals Sel2 and Sel3 becomes gate signals of the TFTs 152 corresponding to 2nd and 3rd columns in Individual blocks belonging to an even-numbered group.

On the other hand, each of odd-numbered groups (A3, A5, A7, . . . , and A95) has three circuit sets each composed of a NOR circuit 1512, a NOT circuit 1514, a NAND circuit 1516, and a NOT circuit 1518, which are corresponding to the control signals Sel1→Sel2, and to Sel3. Among them, the NOT signal of the NOT circuit 1518 output corresponding to the control signal Sel1 becomes gate signals of the TFTs 152 corresponding to 1st columns in individual blocks belonging to an odd-numbered group. Similarly, the NOT signal of the NOT circuit 1518 output corresponding to the control signals Sel2 and Sel3 becomes gate signals of the TFTs 152 corresponding to 2nd and 3rd columns in individual blocks belonging to an even-numbered group.

In addition, since only one sampling signal S1 corresponds to the first odd-numbered group A1 unlike other odd-numbered groups (A3, A5, A7, . . . , and A95), the NOR circuit 1512 and the NOT circuit 1514 do not exist in the first odd-numbered group.

Here, in the second embodiment, if the number of a sampling signal which is set to an H level is an odd number, the control signals Sel1, Sel2, and Sel3 designate sampling of a data signal to be supplied to an image signal line, with respect to the data lines in 1st columns, 2nd columns, and 3rd columns in individual blocks belonging to a group with the same number as the number of the sampling signal, and if the number of a sampling signal which is set to an H level is an even number, the control signals Sel1, Sel2, and Sel3 designate sampling of a data signal to be supplied to an image signal line, with respect to the data lines in 1st columns, 2nd columns, and 3rd columns in individual blocks belonging to a group with a number greater by one than the number of the sampling signal.

On the other hand, if the number of a sampling signal which is set to an H level is an odd number, the control signals Sel5, Sel6, and Sel7 designate sampling of a data signal to be supplied to an image signal line, with respect to the data lines in 1st columns, 2nd columns and 3rd columns in individual blocks belonging to a group with a number greater by one the number of the sampling signal, and if the number of a sampling signal which is set to an H level is an even number, the control signals Sel5, Sel6, and Sel7 designate sampling of a data signal to be supplied to an image signal line, with respect to the data lines in 1st columns, 2nd columns, and 3rd columns in individual blocks belonging to a group with the same number as the number of the sampling signal.

Figure 25:
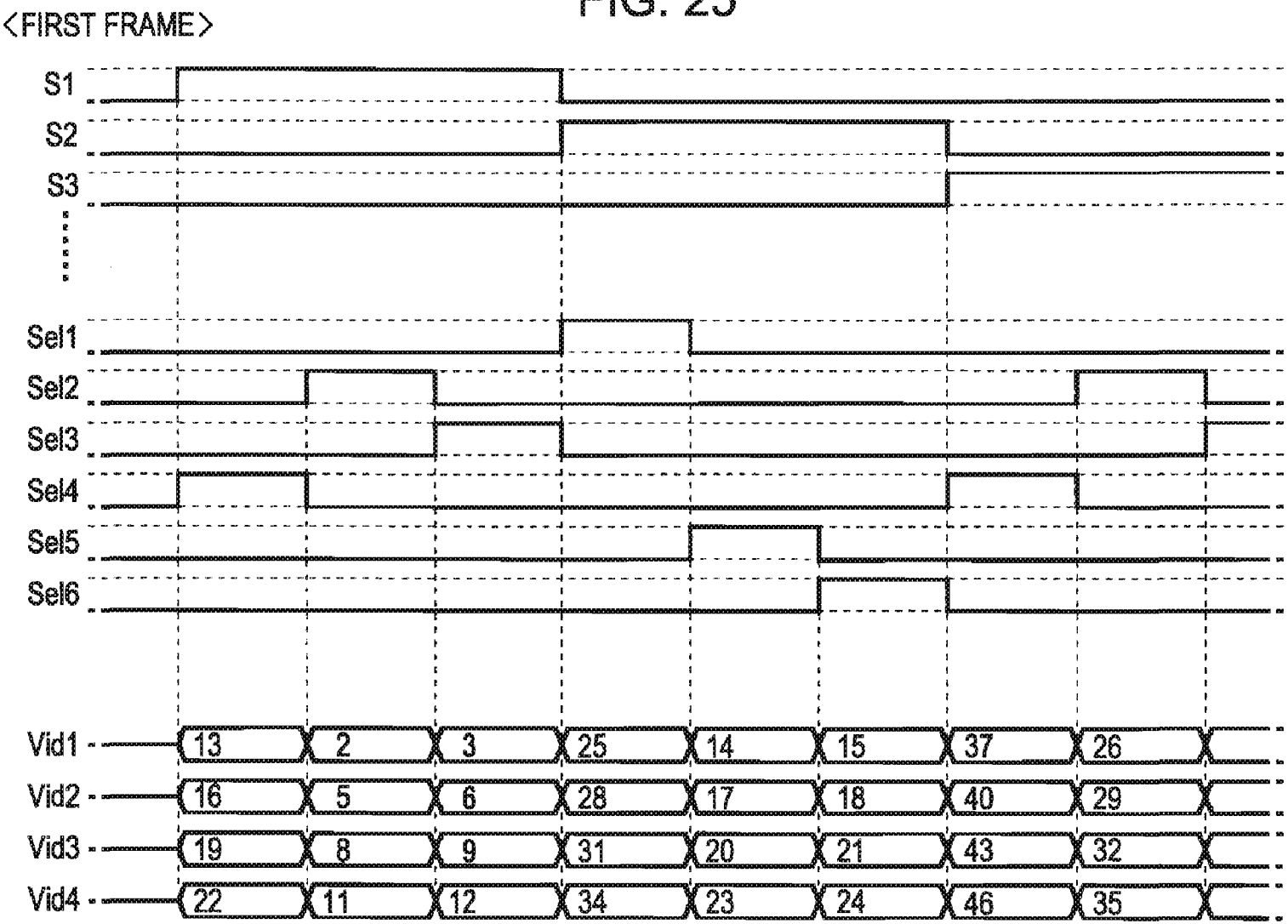
FIG. 25 is a view illustrating the operation of a first frame of the electro-optical device.

In the second embodiment, in the first frame, the order that the control signals Sel1 to Sel6 are set to an H level, as shown in FIG. 25, is as follows: Sel4→Sel2→: Sel3 in the period in which a sampling signal with an odd number is set to an H level, and Sel1→Sel5→Sel6 in the period in which a sampling signal with an even number is set to an H level. Therefore, in the first frame, the distribution of three kinds of pixels whose number of times of write-in to adjacent pixels after write-in is two, one, and zero, becomes as shown in FIG. 28.

Figure 26:
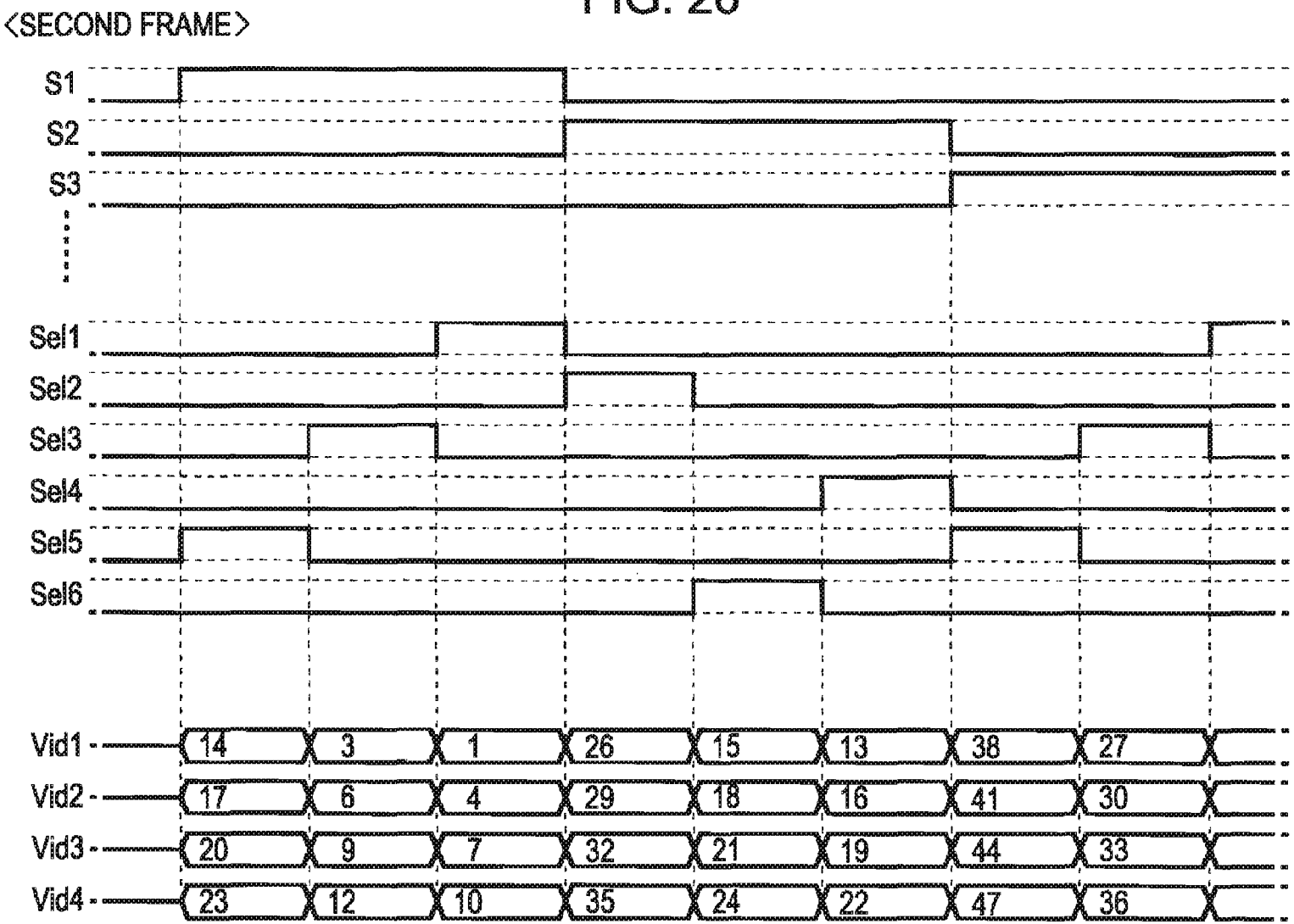
FIG. 26 is a view illustrating the operation of a second frame of the electro-optical device.

Next, in the second frame of the second embodiment, the order that the control signals Sel1 to Sel6 are set to an H level, as shown in FIG. 26, is as follows: Sel5→Sel3→: Sel1 in the period in which a sampling signal with an odd number is set to an H level, and Sel2→Sel6→Sel4 in the period in which a sampling signal with an even number is set to an H level. Accordingly, in the second frame, the distribution of three kinds of pixels whose number of times of write-in to adjacent pixels after write-in is two, one, and zero, becomes as shown In FIG. 29.

Figure 27:
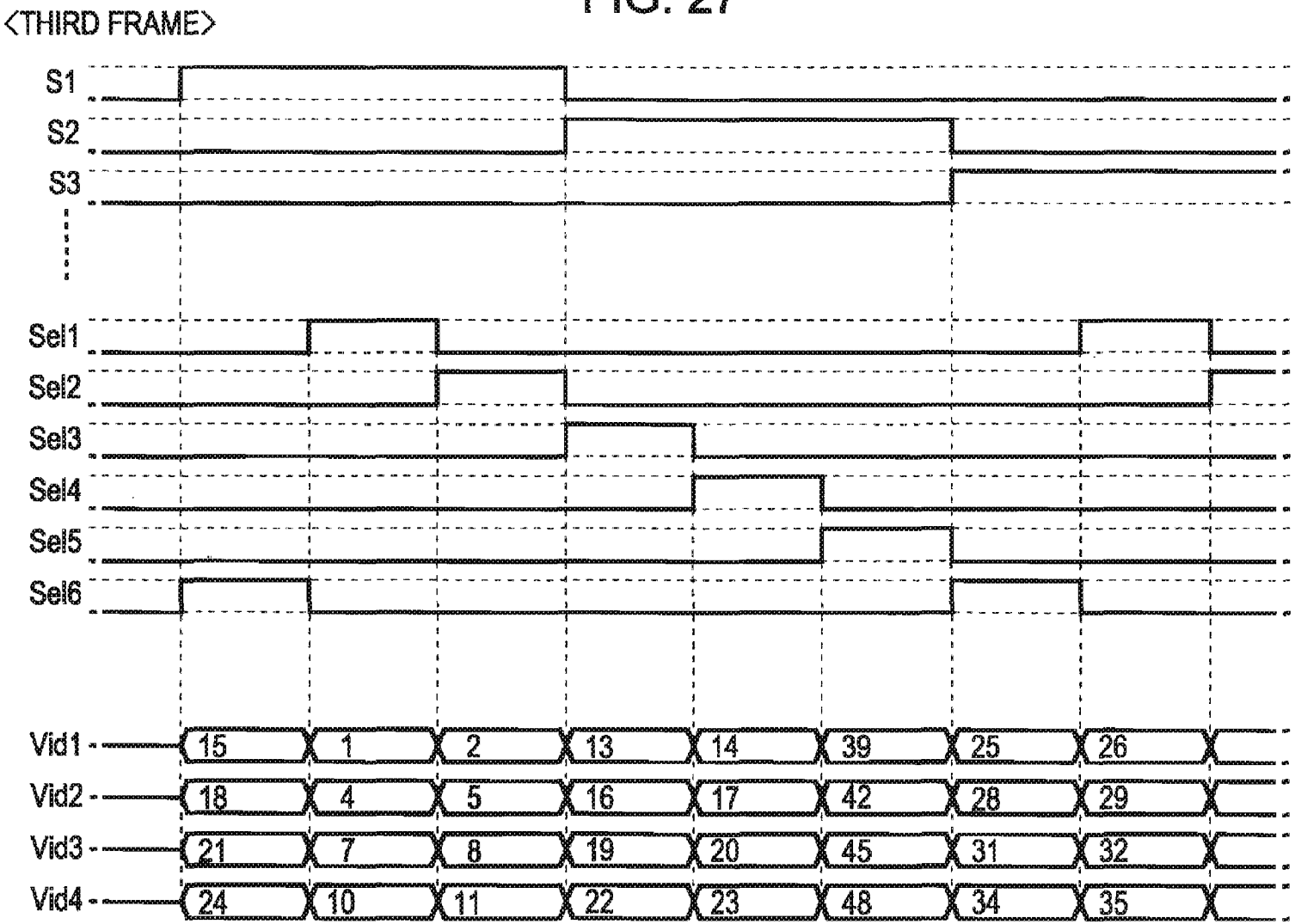
FIG. 27 is a view illustrating the operation of a third frame of the electro-optical device.

Subsequently, in the third frame of the second embodiment, the order that the control signals Sel1 to Sel6 are set to an H level, as shown in FIG. 27, is as follows: Sel6→Sel1→Sel2 in the period in which a sampling signal with an odd number is set to an H level, and Sel3→Sel4→Sel5 in the period in which a sampling signal with an even number is set to an H level. Accordingly, in the third frame, the distribution of three kinds of pixels whose number of times of write-in to adjacent pixels after write-in is two, one, and zero, becomes as shown in FIG. 30.

Figure 28:
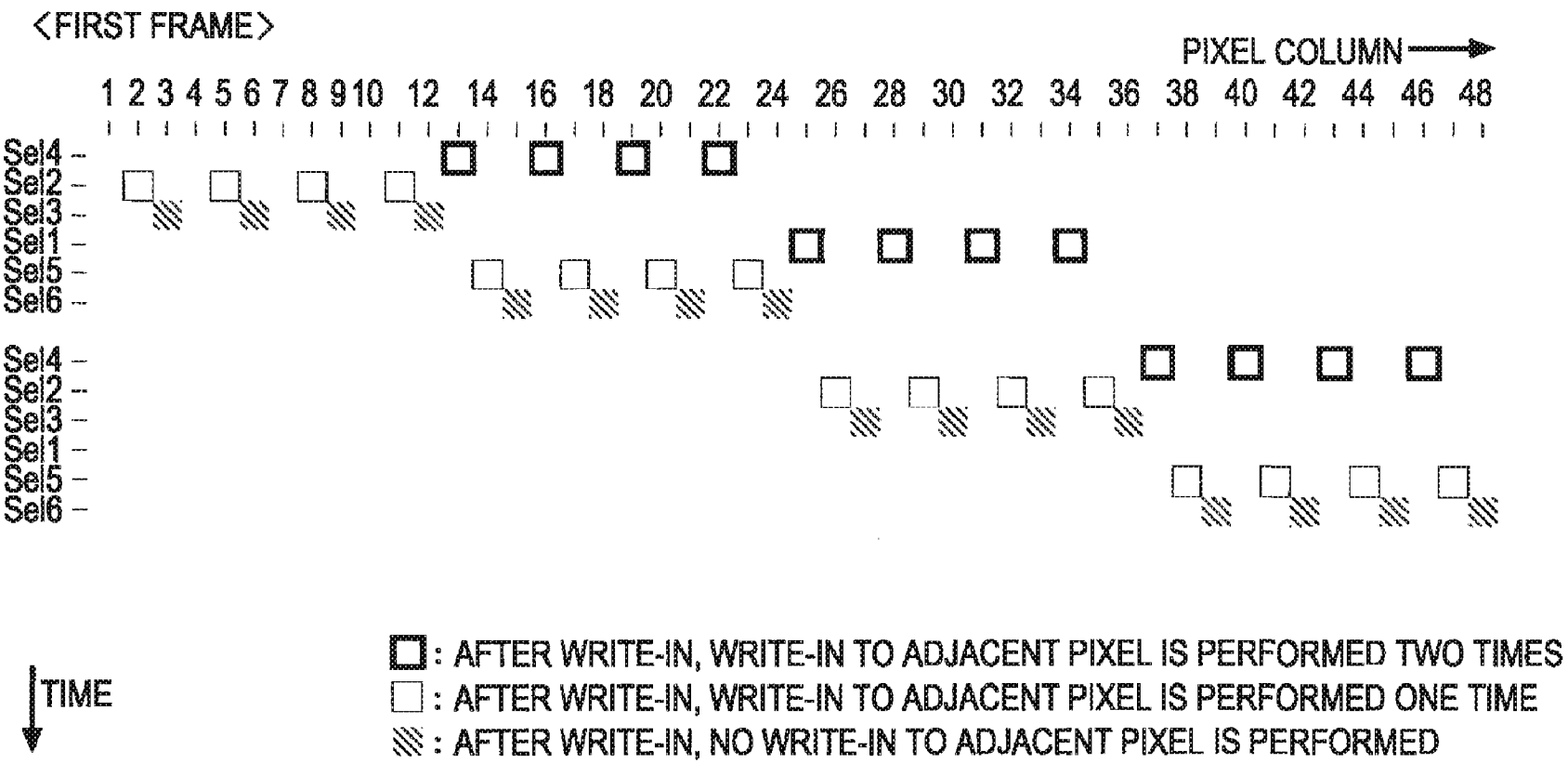
FIG. 28 is a view showing write-in states of the pixels in the first frame of the electro-optical device.
Figure 29:
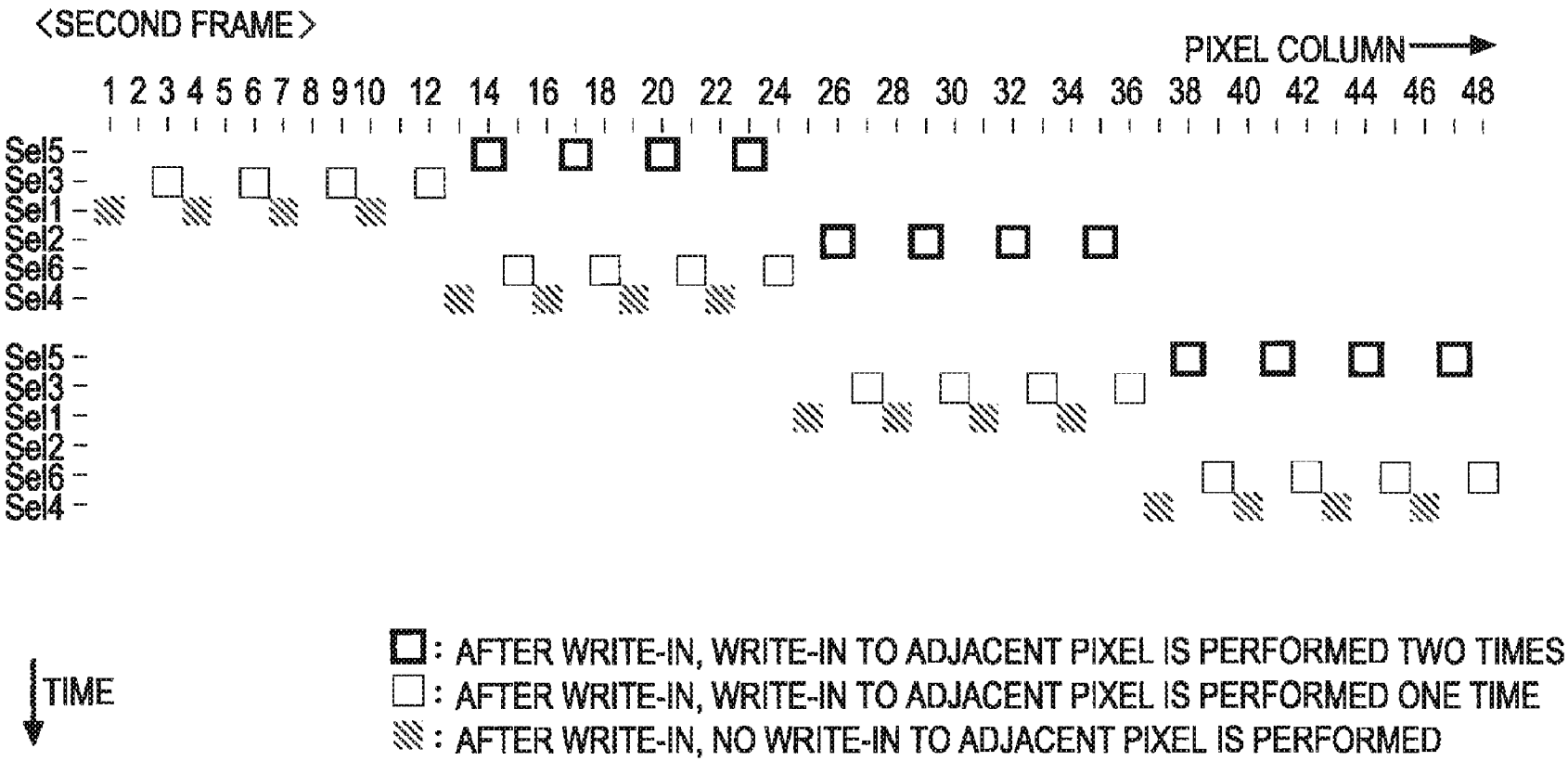
FIG. 29 is a view showing write-in state of pixels in the second frame of the electro-optical device.
Figure 30:
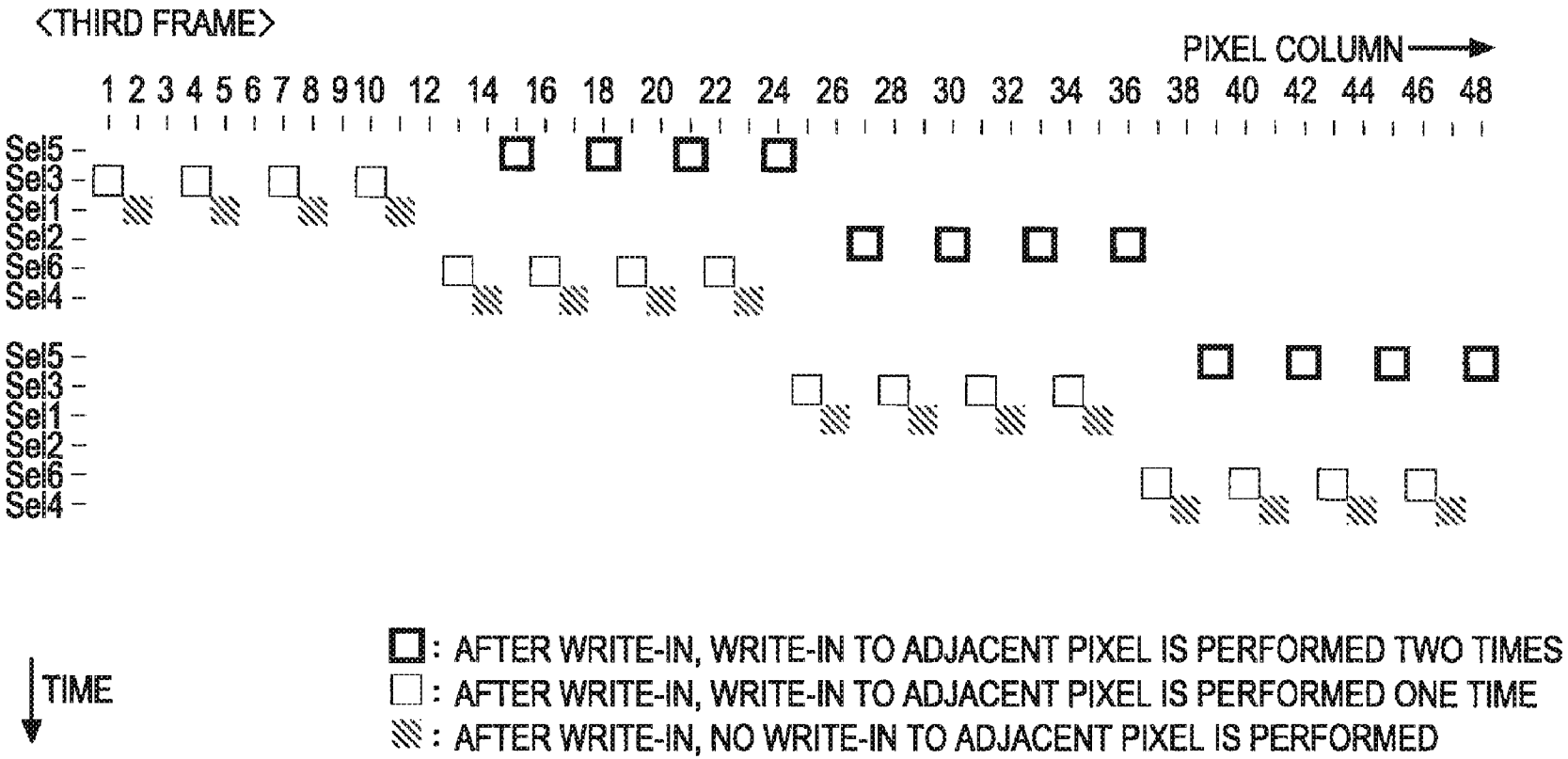
FIG. 30 is a view showing write-in state of pixels in the third frame of the electro-optical device.

As can also be understood from FIGS. 28 to 30, since the write-in (sampling) conditions about each pixel (data line) related to the effective display region (13th to 1140th columns) are satisfied when the first to three frames are defined as one cycle, display unevenness can be hardly recognized visually.

In addition, in the second embodiment, the pixels in the 1st to 12th columns and the 1141st to 1152nd columns do not satisfy the conditions in other pixels even if three frames are defined as one cycle. Therefore, in the second embodiment, although the pixels in the 1st to 12th columns and the 1141st to 1152nd columns become dummy pixels, the effective display region is enlarged as compared with the first embodiment.

Moreover, regardless of a frame number, the alternating current driving which exchanges the write-in polarities of odd rows and even rows with each other for every frame is performed.

Third Embodiment

Subsequently, an electro-optical device (m=2, n=4) according to a third embodiment of the invention will be described.

Figure 31:
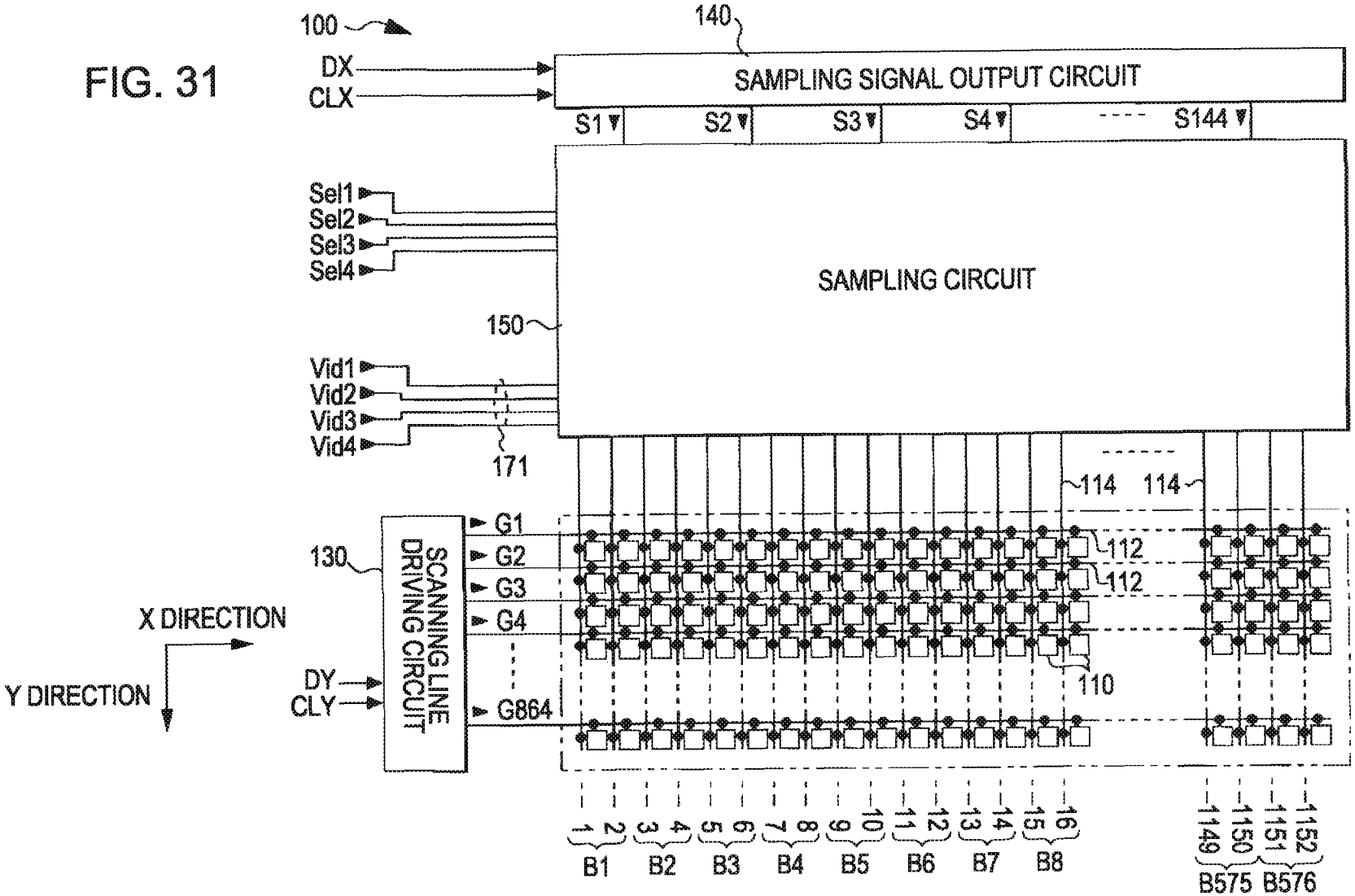
FIG. 31 is a view showing a display panel of an electro-optical device according to a third embodiment of the invention.
Figure 32:
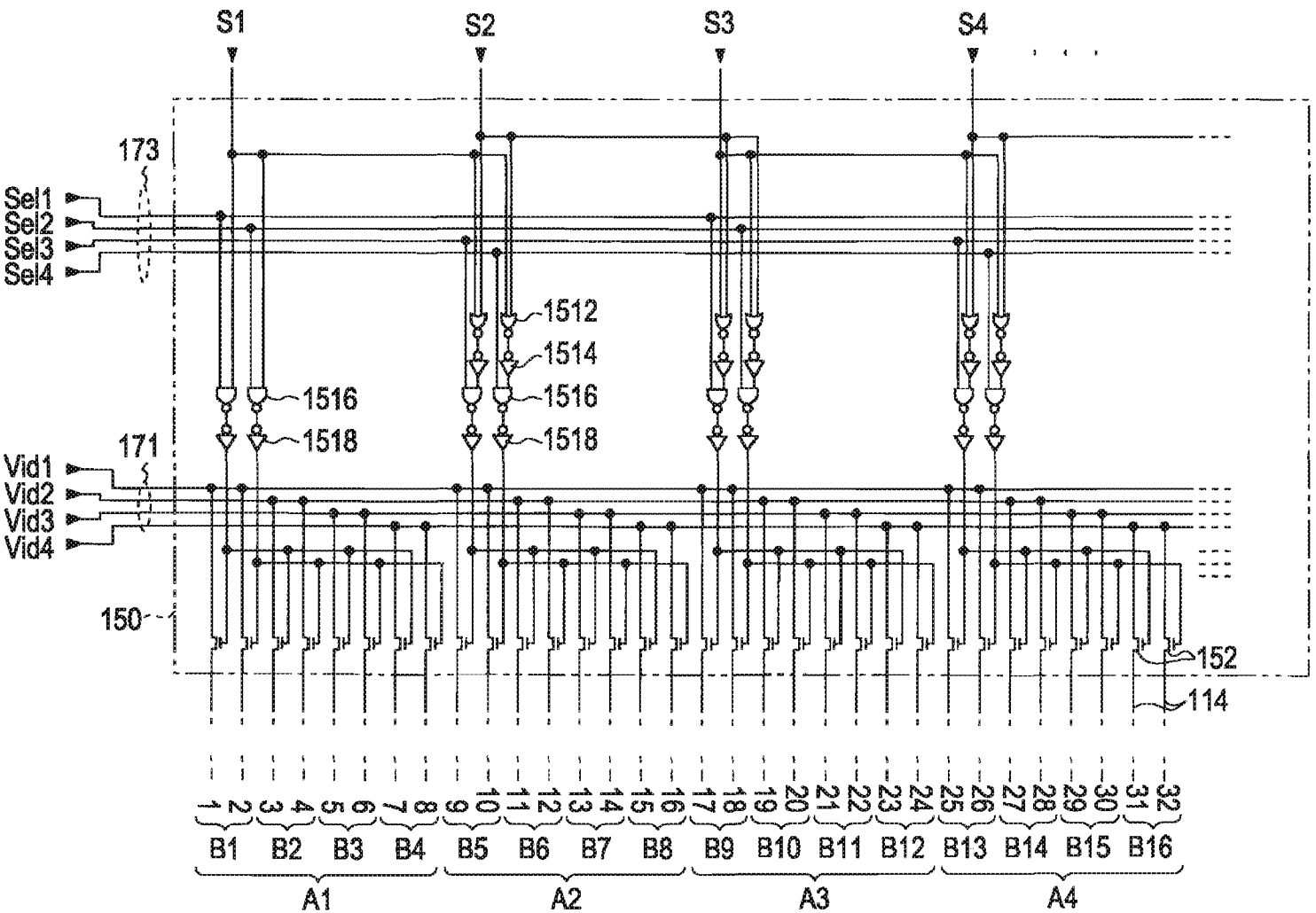
FIG. 32 is a view showing a configuration around a sampling circuit in the display panel.

In this third embodiment, the control signals Sel1 to Sel4 are adopted in the display panel 100 as shown in FIG. 31, and the sampling circuit 150 is configured as shown in FIG. 32. Moreover, in the third embodiment, the scanning control circuit 52 outputs the control signals Sel1 to Sel6, as shown on the right in parentheses of FIG. 1.

Now, as shown in FIGS. 31 and 32, the third embodiment differs in blocks and groups from the first and second embodiments. In addition, in this embodiment, the data lines 114 of 1152 columns are blocked every two columns. Therefore, 1st, 2nd, 3rd, . . . , and 576th blocks when being numbered from the left are denoted by B1, B2, B3, . . . , and B576, respectively.

In addition, as shotgun in FIG. 32, grouping is the same as those of the first and second embodiments in that the grouping is performed every four blocks. In addition, in the third embodiment, since blocks to a block B586 exists, though not shown in FIG. 32, groups to a group A144 also exist. The third embodiment is the same as the first and third embodiments in that each of the groups A2 to A144 except the group A1 corresponds to a sampling signal with the same number as each group number and a sampling signal with a number lower by one than the group number, and the group A1 corresponds to only the sampling signal S1.

The connecting relation of the sources of the TFTs 152 is the same as those of the first and second embodiments. That is, referring to FIG. 32, the sources of the TFTs 152 belonging to the blocks B1, B5, B9, . . . , and B573 are connected to a first image signal line 171 to which the data signal Vid1 is supplied. Similarly, the sources of the TFTs 152 belonging to the blocks B2, B6, B10, . . . , and B574 are connected to a second image signal line 171 to which the data signal Vid2 is supplied, the sources of the TFTs 152 belonging to the blocks B3, B7, B11, . . . , and B575 are connected to a third image signal line 171 to which the data signal Vid3 is supplied, and the sources of the TFTs 152 belonging to the blocks B4, B8, B12, . . . , and B576 are connected to a fourth image signal line 171 to which the data signal Vid4 is supplied.

Moreover, the third embodiment is the same as the first and third embodiments in that the gates of the TFTs 152 in the same columns in individual blocks belonging to the same group are connected in common.

Here, the gate signals supplied to the TFTs 152 are divided into even-numbered groups and odd-numbered groups, and has the following relationship.

That is, each of the even-numbered groups (A2, A4, A6, . . . , and A144) is provided with two circuit sets corresponding to the control signals Sel3 and Sel4. Each of the two circuit sets is composed of a NOR circuit 1512 which outputs a NOR signal between correponding sampling signals, a NOT circuit 1514 which outputs a NOT signal of the NOR signal, a NAND circuit 1516 which outputs a NAND signal of the NOT signal and any one of the control signals Sel3 and Sel4, and a NOT circuit 1518 which outputs a NOT signal of the NAND signal.

Among them, the NOT signal of the NOT circuit 1518 output corresponding to the control signal Sel3 becomes gate signals of the TFTs 152 corresponding to 1st columns in individual blocks belonging to an even-numbered group. Similarly, the NOT signal of the NOT circuit 1518 output corresponding to the control signal Sel4 becomes gate signals of the TFTs 152 corresponding to 2nd columns in individual blocks belonging to an even-numbered group.

On the other hand, each of odd-numbered groups (A3, A5, A7, . . . , and A143) has two circuit sets each composed of a NOR circuit 1512, a NOT circuit 1514, a NAND circuit 1516, and a NOT circuit 1518, which are corresponding to the control signals Sel1 and Sel2. Among them, the NOT signal of the NOT circuit 158 output corresponding to the control signal Sel1 becomes gate signals of the TFTs 152 corresponding to 1st columns in individual blocks belonging to an odd-numbered group. Similarly, the NOT signal of the NOT circuit 1518 output corresponding to the control signal Sel2 becomes gate signals of the TFTs 152 corresponding to 2nd columns in individual blocks belonging to an even-numbered group.

In addition, since only one sampling signal S1 corresponds to the first odd-numbered group A1 unlike other odd-numbered groups (A3, A5, A7, . . . , and A144), the NOR circuit 1512 and the NOT circuit 1514 do not exist in the first odd-numbered group.

Here, in the third embodiment, if the number of a sampling signal which is set to an H level is an odd number, the control signals Sel1 and Sel2 designate sampling of a data signal to be supplied to an image signal line, with respect to the data lines in 1st columns and 2nd columns in individual blocks belonging to a group with the same number as the number of the sampling signal, and if the number of a sampling signal which is set to an H level is an even number, the control signals Sel1 and Sel2 designate sampling of a data signal to be supplied to an image signal line, with respect to the data lines in 1st columns and 2nd columns in individual blocks belonging to a group with a number greater by one than the number of the sampling signal.

Figure 33:
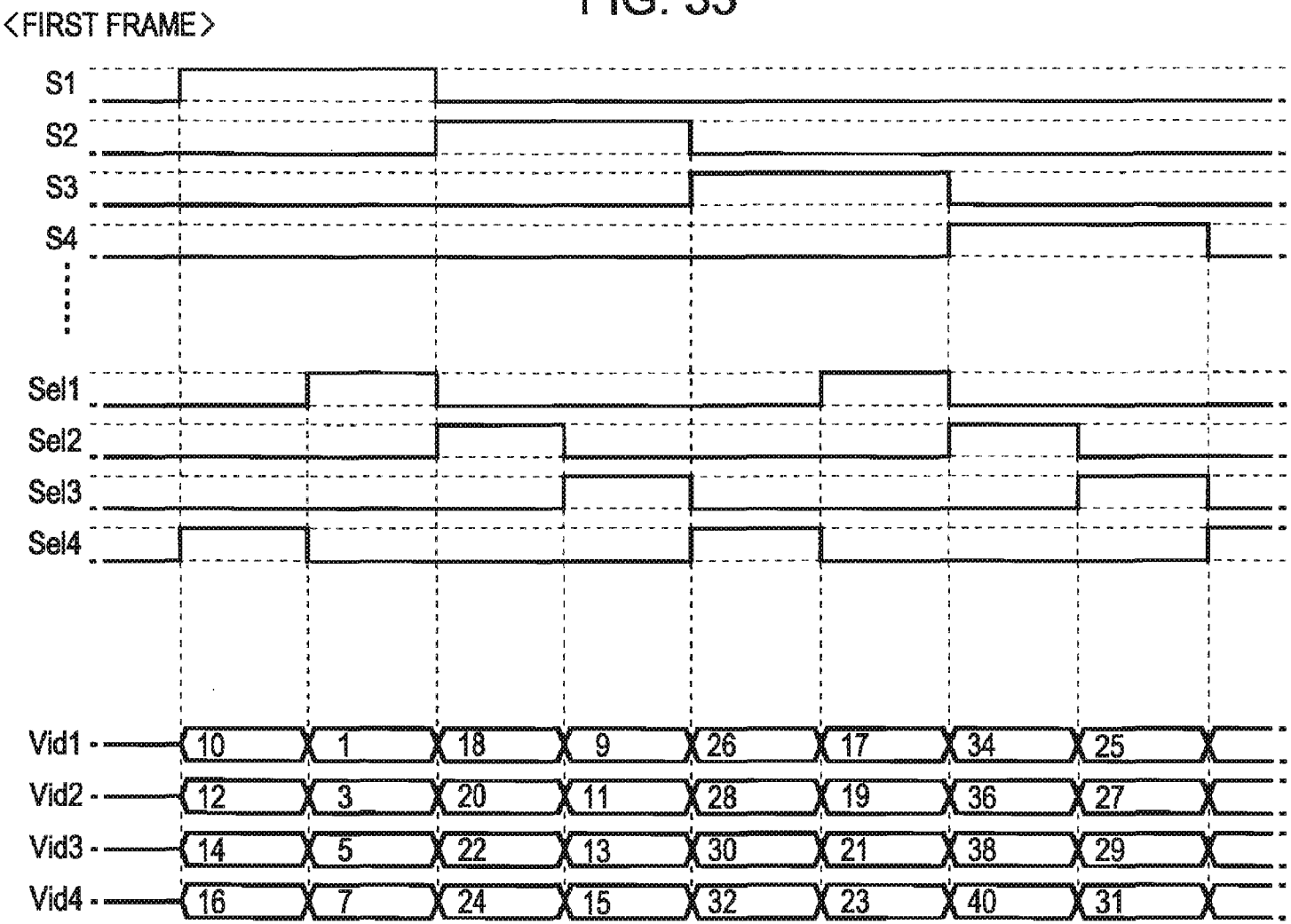
FIG. 33 is a view illustrating the operation of a first frame of the electro-optical device.

On the other hand, if the number of a sampling signal which is set to an H level is an odd number, the control signals Sel3 and Sel4 designate sampling of a data signal to be supplied to an image signal line, with respect to the data lines in 1st columns and 2nd columns in individual blocks belonging to a group with a number greater by one the number of the sampling signal, and if the number of a sampling signal which is set to an H level is an even number, the control signals Sel3 and Sel4 designate sampling of a data signal to be supplied to an image signal line, with respect to the data lines in 1st columns and 2nd columns in individual blocks belonging to a group with the same number as the number of the sampling signal.

in the first frame of the third embodiment, the order that the control signals Sel1 to Sel4 are set to an H level, as shown in FIG. 33, is as follows: Sel4→Sel1 in the period in which a sampling signal with an odd number is set to an H level, and Sel2→Sel3 in the period in which a sampling signal with an even number is set to an H level. Therefore, in the first frame, the distribution of three kinds of pixels whose number of times of write-in to adjacent pixels after write-in is two, one, and zero, becomes as shown in FIG. 35.

Figure 34:
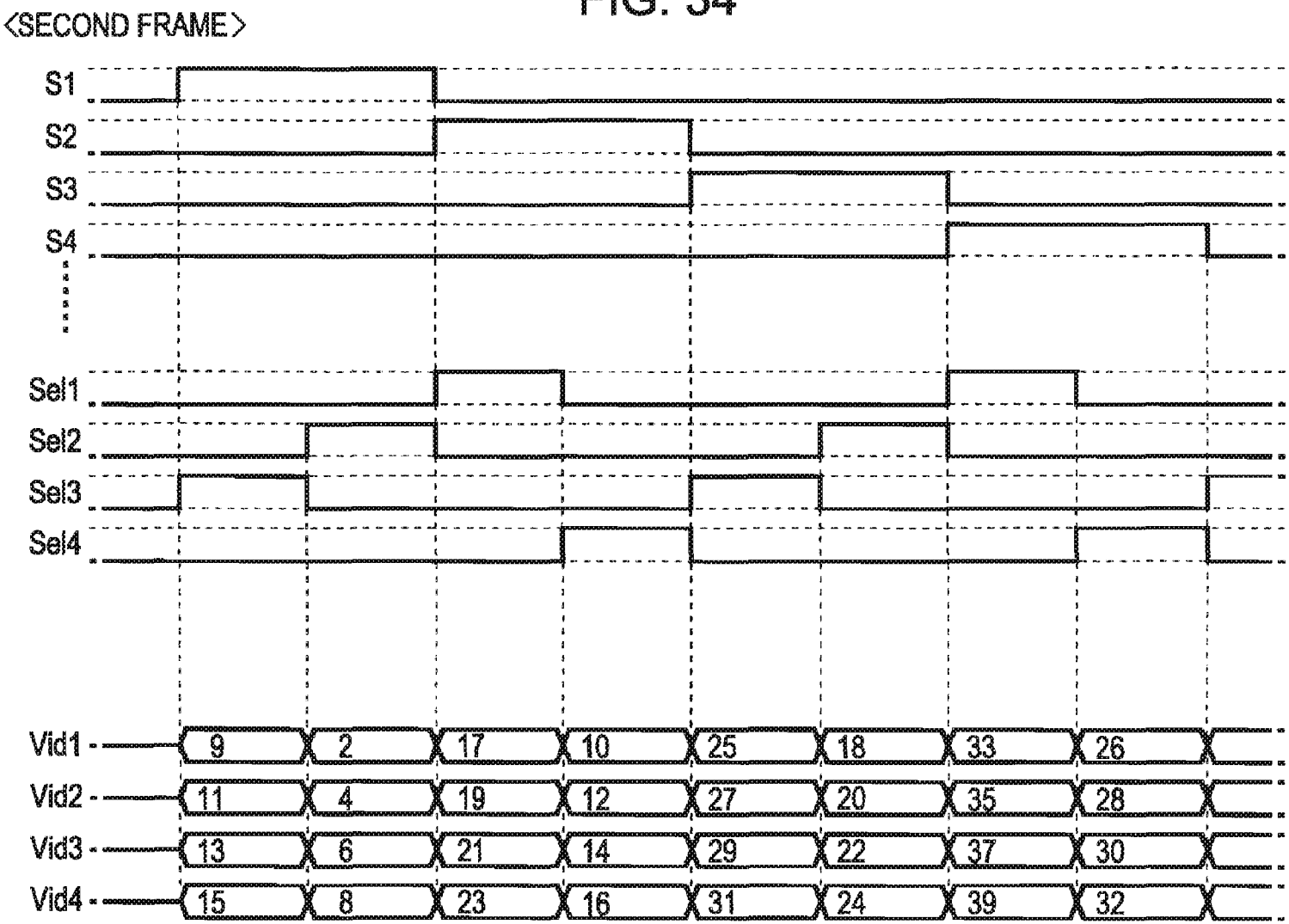
FIG. 34 is a view illustrating the operation of a second frame of the electro-optical device.

Next, in the second frame of the third embodiment, the order that the control signals Sel1 to Sel4 are set to an H level, as shown in FIG. 34, is as follows: Sel3→Sel2 in the period in which a sampling signal with an odd number is set to an H level, and Sel1→Sel4 in the period in which a sampling signal with an even number is set to an H level. Accordingly, in the second frame, the distribution three kinds of pixels whose number of times of write-in to adjacent pixels after write-in is two, one, and zero, becomes as shown in FIG. 36.

Figure 35:
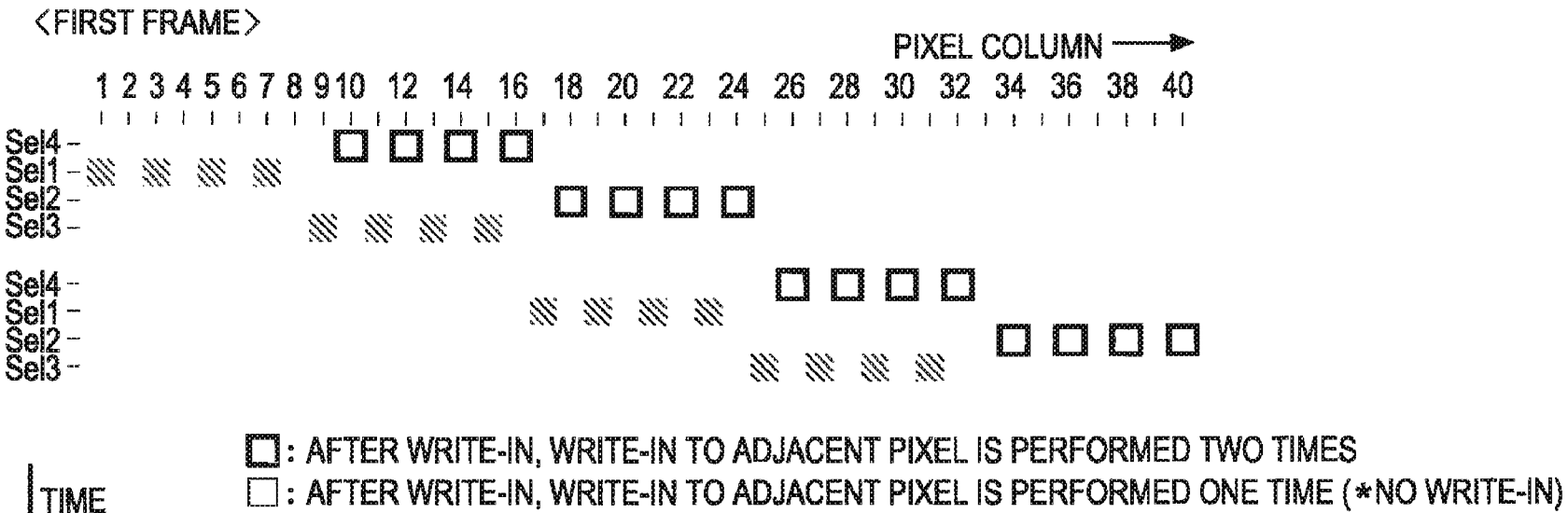
FIG. 35 is a view showing write-in states of the pixels in the first frame of the electro-optical device.
Figure 36:
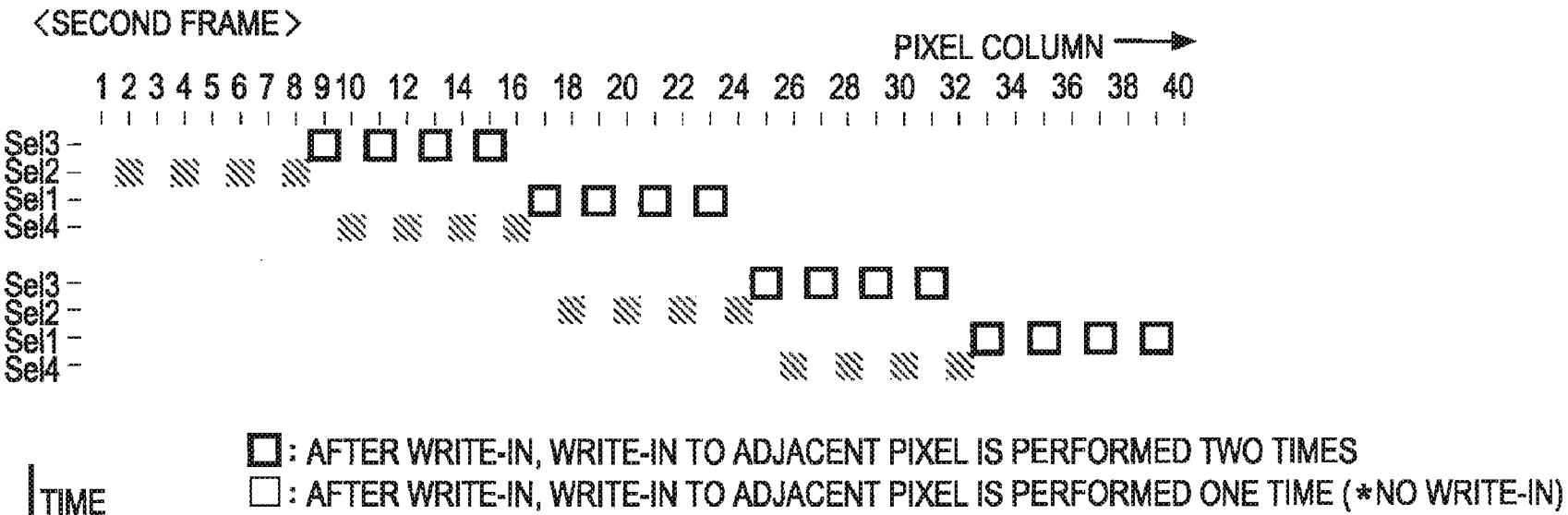
FIG. 36 is a view showing write-in states of the pixels in the second frame of the electro-optical device.

As can also be understood from FIGS. 35 and 36, since the write-in (sampling) conditions about each pixel (data line) related to the effective display region (9th to 1144th columns) are satified when the first and second frames are defined as one cycle, display unevenness can be hardly recognized visually.

In addition, in the third embodiment, the pixels in the 1st to 8th columns and the 1145th to 1152nd columns do not satisfy the conditions in other pixels even if two frames are defined as one cycle. Therefore, in the third embodiment, although the pixels in the 1st to 9th columns and the 1145th to 1152nd columns become dummy pixels, the effective display region is further enlarged as compared with the first and second embodiment.

In addition, in the above-described first to embodiments, the image data Vin is developed into four-phase image signals. However, the number "n" of systems to be developed is not limited to "4," and it needs to be only "2" or more.

Moreover, in the above-described respective embodiments, all the data lines 114 may be precharged with a predetermined voltage (for example, Vc) in the horizontal blanking period before a data signal is sampled.

In the above-described embodiments, although the processing circuit 50 processes the digital image data Vin, analog image signals may be input to and phase-developed by the processing circuit.

Moreover, in the embodiments, the voltage LCcom to be applied to the common electrode 108 is allowed to coincide with the potential VC that is a reference of polarity reversals. However, a phenomenon (called pushdown, running, field-through, etc.) occurs that the potential of the drain (pixel electrode 118) drops at the time from ON to OFF due to the parasitic capacitance between the gate and the drain of the TFT 152. In order to prevent deterioration of liquid crystal, since alternating current driving is principally adopted in the pixel capacitor, mutual write-in is carried out on the high potential side positive polarity) and low potential side (negative polarity). However, if the mutual write-in is carried out in a state in which the voltage LCcom is allowed to coincide with the voltage VC, the voltage effective value of the pixel capacitor may become larger in negative-polarity write-in than in positive-polarity write-in due to the pushdown Therefore, even if positive-polarity write-in and negative-polarity write-in are carried out on the same grayscale, the voltage LCcom of the common electrode 108 may be set to be a little lower than the potential VC that is an amplitude reference of a data signal so that the voltage effective values of liquid crystal capacitors may become equal to each other.

Moreover, in the embodiment, the vertical scanning direction is downward in order of G1→G864 and the horizontal scanning direction is rightward in order of S1→S72 (S96, S144). However, in order to cope with the cases in which a projector and a rotatable display device as described below are considered, the scanning directions may be made switchable.

Furthermore, when the voltage effective value of a pixel capacitor is small, the invention can be applied to a normally black mode which performs black display as well as the normally white mode that performs white display.

In the above-described embodiments, TN type liquid crystal is used. However, liquid crystals may be used, such as liquid crystal of BTN (Bi-stable Tewised Nematic) type, liquid crystal of ferroelectric type, or liquid crystal of the guest host type in which a dye (guest) having anisotropy for absorption of visible light along the major axis direction and minor axis direction of molecules is dissolved in liquid crystal (host) with the constant molecular alignment to arrange the dye molecules parallel in parallel with the liquid crystal molecules.

Morevoer, a configuration of vertical alignment (homeotropic alignment) may be adopted in which liquid crystal molecules are arranged in a direction vertical to both substrates when no voltage is applied, while liquid crystal molecules are arranged in a direction horiztal to both substrates when a voltage is applied. In addition, a configuration of parallel (horizontal) alignment (homogeneous alignment) may be adopted in which liquid crystal molecules are arranged in a direction horizontal to both substrates when no voltage is applied, while liquid crystal molecules are arranged in a direction vertical to both substrates when a voltage is applied.

Furthermore, the invention is not limited to use of liquid crystal as an electro-optical substance, but the invention may be applied to a variety of liquid crystal types and alignment modes, as described above.

Although the invention has been described in conjunction with the liquid crystal device the invention can be applied to devices using, for example, an EL (Electronic Luminescence) element, an electron emission element, an electrophoresis element, a digital mirror element, etc., a plasma display, and the like, if they has a configuration in which image data (video signals) is phase-developed.

Electronic Apparatus

Next, a projector using the above-described display panel 100 as a light valve will be described as an example of an electronic apparatus using the electro-optical device related to the above-described embodiments.

Figure 37:
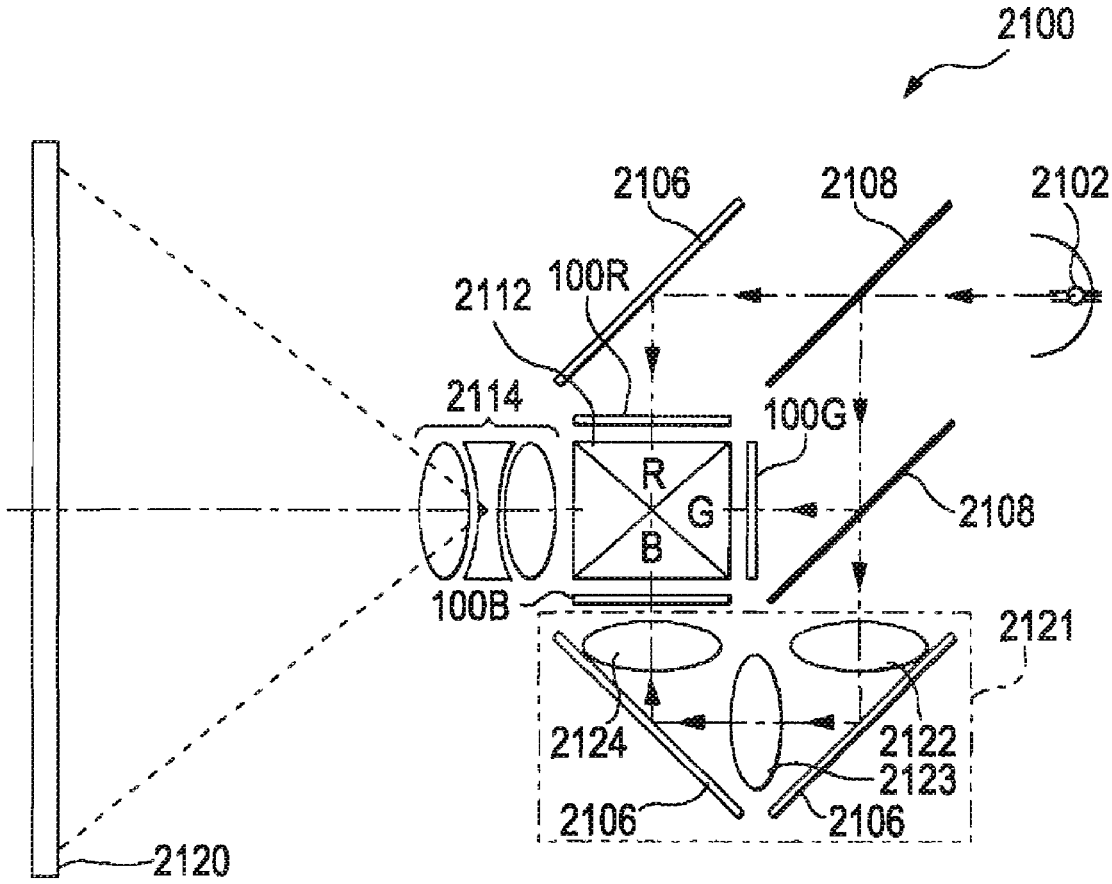
FIG. 37 is a view showing a configuration of a projector to which the electro-optical device is applied.

FIG. 37 is a plan view showing a configuration of this projector. As shown in this drawing, a lamp unit 2102 composed of a white light source such as a halogen lamp is provided inside a projector 2100. Projection light emitted from the lamp unit 2102 is split into light components corresponding to three primary colors of red (R), green (G) and blue (B) by three mirrors 2106 and two dichroic mirrors 2108, which are arranged within the projector. The light components are guided to light valves 100R, 100B and 100G corresponding to the primary colors, respectively. In addition, since the blue (B) light component has its long optical path as compared with the other red (R) and green (G) light components, the blue light component is guided through a relay lens system 2121 composed of an incidence lens 2122, a relay lens 2123, and an emission lens 2124, in order to prevent its loss.

Here, the light valves 100R, 100G and 100B have the same configuration as the display panel 110 in the above described embodiments, and are driven by image signals corresponding to the RGB colors, respectively, which are supplied from a processing circuit omitted in FIG. 37). That is, this projector 2100 has a configuration in which three sets of electro-optical devices each including the display panel 100 are provided corresponding to R, G, and B colors, respectively.

The light components modulated by the light valves 100R, 100G and 100B are incident into a dichroic prism 2112 in three directions. In the dichroic prism 2112, the red (R) and blue (B) light components are refracted by 90 degrees, while the green (G) light component goes straight. Accordingly, images of individual colors are synthesized, and then, a color image is projected onto a screen 2120 through a projector lens 2114.

In addition, since light components corresponding to primary colors of red (R), green (G) and blue (B), respectively, are incident into the light valves 100R, 100G, and 100B by the dichroic mirrors 2108, it is not necessary to provide any color filter. Moreover, transmission images of the light valves 100R and 100B are projected after being reflected by the dichroic mirror 2112, whereas a transmission image of the light valve 100G is projected as it is. Thus, an image whose right and left are reversed is displayed by making the horizontal scanning direction by the light valves 100R and 100B reverse to the horizontal scanning direction by the light valve 100G.

As electronic apparatuses, in addition to the above-described projector referring to FIG. 37, various apparatuses, such as television sets, view-finder-type or monitor-direct-viewing-type video tape recorders, car navigation systems, pagers, electronic organizers, word processors, work stations, video phones, POS (Point of Sale) terminals, apparatuses having a touch panel, and the like, can be exemplified. It goes without saying that the above-described electro-optical device can be applied to these various electronic apparatuses.

What is claimed is:

1. An electro-optical device comprising:

a plurality of scanning lines, a plurality of data lines blocked for every "m" (m is an integer of 2 or greater) columns, pixels provided corresponding to the scanning lines and the data lines and showing grayscale specified by data signals sampled to data lines when a scanning line is selected, image signal lines, a scanning line driving circuit which selects the scanning line in a predetermined order, a sampling signal output circuit which sequentially outputs a plurality of sampling signals, and a sampling circuit which has a sampling switches for each data lines and the sampling switches being connected to the corresponding data lines, the sampling circuit turning on the sampling switches to sample data signals supplied to "n" (n is an integer of 2 or greater) of the image signal lines, to the data lines, the blocks being grouped into "n" blocks, individual blocks in the same group corresponding to different image signal lines, and the sampling switches in the individual blocks being connected to corresponding image signal lines, a scanning control circuit which sequentially outputs a plurality of scanning control signals to the sampling circuit where one half of the plurality of scanning control signals are applied to odd numbered groups and another half of the plurality of scanning control signals are applied to even numbered groups, one sampling signal being supplied to two adjacent groups, when any one sampling signal is supplied, sampling switches in the same columns in "n" blocks belonging to one group of two groups corresponding to the sampling signal are simultaneously turned on, the scanning control circuit sequentially outputs 2m or more scanning control signals, and a first half of the 2m or more scanning control signals are provided to control the sampling switches in the odd numbered groups, and a second half of the 2m or more scanning control signals are provided to control the sampling switches of the even numbered groups.

2. The electro-optical device according to claim 1, wherein the sampling circuit turns on sampling switches in any numbered columns in "n" blocks belonging to one group of two groups corresponding to the sampling signal, and thereafter, turns on sampling switches in any numbered columns in "n" blocks belonging to the other group.

3. The electro-optical device according to claim 1, wherein the sampling circuit turns on sampling switches in the same columns in two groups corresponding to the sampling signal, in a predetermined order for every frame by groups over a period in which the sampling signal is supplied and a period in which a sampling signal next to the previous sampling signal is supplied.

4. The electro-optical device according to claim 3, wherein the sampling circuit turns on the sampling switches according to 2m or more predetermined control signals.

5. The electro-optical device according to claim 3, wherein the distributions of the generation frequency of sampling in adjacent data lines after sampling of a data signal during one frame are made equal over individual data lines when at least "m" frames are defined as one cycle.

6. The electro-optical device according to claim 4, wherein the sampling circuit has an OR circuit which acquires an OR signal of two sampling signals, and an AND circuit which acquires an AND signal of the OR signal and any one of the 2m or more control signals, and instructs either ON or OFF of sampling switches in any numbered columns in one group.

7. The electro-optical device according to claim 1, further comprising a processing circuit which supplies data signals of pixels corresponding to intersections of a selected scanning line and data lines whose sampling switches are turned on, to the "n" image signal lines.

8. An electronic apparatus comprising the electro-optical device according to claim 1.

9. The electro-optical device according to claim 1, wherein under the condition that an odd-numbered sampling signal is applied, the first half of the 2m or more scanning control signals control sampling switches in the same columns in "n" blocks of the "mth" group, and the second half of the 2m or more scanning control signals control sampling switches in the same columns in "n" blocks of the "mth+1" group, and under the condition that an even-numbered sampling signal is applied, the first half of the 2m or more scanning control signals control sampling switches in the same columns in "n" blocks of the "mth+1" group, and the second half of the 2m or more scanning control signals control sampling switches in the same columns in "n" blocks of the "mth" group.

10. A method of driving an electro-optical device, the electro-optical device including:

pixels provided corresponding to a plurality of scanning lines and data lines blocked for every "m" columns (m is an integer of 2 or greater);

a scanning line driving circuit;

a sampling signal output circuit;

a sampling circuit which has sampling switches provided in the data lines, respectively, and each having one end connected to the data lines; and a scanning control circuit, the method comprising:

displaying grayscale specified by data signals sampled to data lines when a scanning line is selected, selecting the plurality of scanning lines in a predetermined order with the scanning line driving circuit, sequentially outputting a plurality of sampling signals with the sampling signal output circuit, and turning on the sampling switches to sample data signals supplied to "n" (n is an integer of 2 or greater) image signal lines, to the data lines with the sampling circuit, grouping the blocks for every "n" blocks with the sampling circuit, making individual blocks in the same group correspond to different image signal lines, respectively, to connect the other ends of the sampling switches in the individual blocks to corresponding image signal lines, supplying one sampling signal to two adjacent groups, sequentially outputting with the scanning control circuit a plurality of scanning control signals to the sampling circuit where one half of the plurality of scanning control signals are applied to odd numbered groups and another half of the plurality of scanning control signals are applied to even numbered groups, when any one sampling signal is supplied, simultaneously turning on sampling switches in the same columns in "n" blocks belonging to one group of two groups corresponding to the sampling signal, wherein the scanning control circuit sequentially outputs 2m or more scanning control signals, and a first half of the 2m or more scanning control signals are provided to control the sampling switches in the odd numbered groups, and a second half of the 2m or more scanning control signals are provided to control the sampling switches of the even numbered groups.

* * * * *